US009960549B2

(12) United States Patent
Strelow et al.

(10) Patent No.: US 9,960,549 B2
(45) Date of Patent: May 1, 2018

(54) ELECTRICAL CONNECTOR

(71) Applicant: TE Connectivity Germany GmbH, Bensheim (DE)

(72) Inventors: Markus Strelow, Moerlenbach (DE); Guenter Feldmeier, Lorsch (DE); Martin Szelag, Bickenbach (DE); Bert Bergner, Bensheim (DE); Ralf Schmidt, Fuerth (DE); Christian Schrettlinger, Bensheim-Auerbach (DE); Matthias Haucke, Clingen (DE); In Gon Kang, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 14/943,305

(22) Filed: Nov. 17, 2015

(65) Prior Publication Data

US 2016/0072235 A1 Mar. 10, 2016

Related U.S. Application Data

(63) Continuation of application No. PCT/EP2014/060447, filed on May 21, 2014.

(30) Foreign Application Priority Data

May 21, 2013 (DE) ..... 10 2013 209 327
Nov. 22, 2013 (EP) ..... 13194132

(51) Int. Cl.
*H01R 4/24* (2006.01)
*H01R 24/30* (2011.01)
*H01R 24/64* (2011.01)

(52) U.S. Cl.
CPC ..... *H01R 24/30* (2013.01); *H01R 4/2433* (2013.01); *H01R 24/64* (2013.01)

(58) Field of Classification Search
CPC H01R 23/025; H01R 13/6658; H01R 13/506; H05K 1/0228
(Continued)

(56) References Cited

U.S. PATENT DOCUMENTS 2,673,968 A * 3/1954 Smith ..... H01R 4/2412 439/417
3,879,099 A * 4/1975 Shaffer ..... H01R 12/675 439/397
(Continued)

FOREIGN PATENT DOCUMENTS

CN 101595601 A 12/2009
CN 101901981 A 12/2010
DE 20 2006 018 019 U1 4/2008

OTHER PUBLICATIONS

PCT Search Report and Written Opinion, International Application No. PCT/EP2014/060447, 7 pages, dated Jun. 10, 2014.
(Continued)

*Primary Examiner* — Hien Vu
(74) *Attorney, Agent, or Firm* — Barley Snyder

(57) ABSTRACT

An electrical connector is disclosed. The electrical connector has a middle housing having a first upper contact spring and a first upper opening, an upper cover connected to the middle housing and having a first upper termination clamp, wherein the upper cover rotatably and linearly moves with respect to the middle housing between an open position and a closed position, and a cable having a first core, the first core extending into the first upper opening. In the closed position of the upper cover, the first upper termination clamp contacts the first core in an electrically conductive manner and abuts the first upper contact spring.

16 Claims, 23 Drawing Sheets

(58) Field of Classification Search
USPC ..... 439/676, 409, 417
See application file for complete search history.

(56) References Cited

U.S. PATENT DOCUMENTS

| | | | | |
|---|---|---|---|---|
| 5,947,761 | A * | 9/1999 | Pepe | H01R 4/2433 439/409 |
| 6,682,363 | B1 | 1/2004 | Chang | |
| 7,572,140 | B2 | 8/2009 | Szelag et al. | |
| 7,815,462 | B2 * | 10/2010 | Boeck | H01R 4/2433 439/409 |
| 8,070,506 | B2 * | 12/2011 | De Dios Martin | H01R 4/2433 439/409 |
| 8,764,476 | B1 * | 7/2014 | Ma | H01R 4/2433 439/418 |
| 2008/0050965 | A1 | 2/2008 | Szelag et al. | |
| 2013/0273769 | A1 | 10/2013 | Schutz | |

OTHER PUBLICATIONS

English translation of the First Office Action, dated Jan. 24, 2017, 9 pages.
Chinese Office Action, dated Jan. 24, 2017, 6 pages.
Abstract of CN101901981, dated Dec. 1, 2010, 1 page.
Abstract of CN101595601, dated Dec. 2, 2009, 2 pages.

* cited by examiner

ELECTRICAL CONNECTOR

CROSS-REFERENCE TO RELATED APPLICATIONS

This application is a continuation of PCT International Application No. PCT/EP2014/060447 filed May 21, 2014, which claims priority under 35 U.S.C. §119 to German Patent No. 10 2013 209 327.6 filed May 21, 2013 and European Patent No. 13194132.0 filed Nov. 22, 2013.

FIELD OF THE INVENTION

This invention relates to an electrical connector, and more particularly to an electrical connector transmitting high frequency data signals.

BACKGROUND

Electrical connectors implemented to transmit electrical data signals are known in the prior art. Further, it is well known that electrical connectors provided for data transmission with high data rates at high frequency must be produced and manufactured with high accuracy in order to ensure desired signal integrity. Connectors which are improperly designed and/or manufactured with insufficient accuracy, at high signal frequencies, suffer effects such as crosstalk and reflections which may lead to a deterioration of signal quality. In many known connectors, the required accuracy of manufacturing can only be achieved at great expense and with unsatisfactory reliability.

SUMMARY

An object of the invention is to provide an electrical connector capable of transmitting high signal frequencies that can be manufactured reliably at a lower cost. The disclosed electrical connector has a middle housing having a first upper contact spring and a first upper opening, an upper cover connected to the middle housing and having a first upper termination clamp, wherein the upper cover rotatably and linearly moves with respect to the middle housing between an open position and a closed position, and a cable having a first core, the first core extending into the first upper opening. In the closed position of the upper cover, the first upper termination clamp contacts the first core in an electrically conductive manner and abuts the first upper contact spring.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
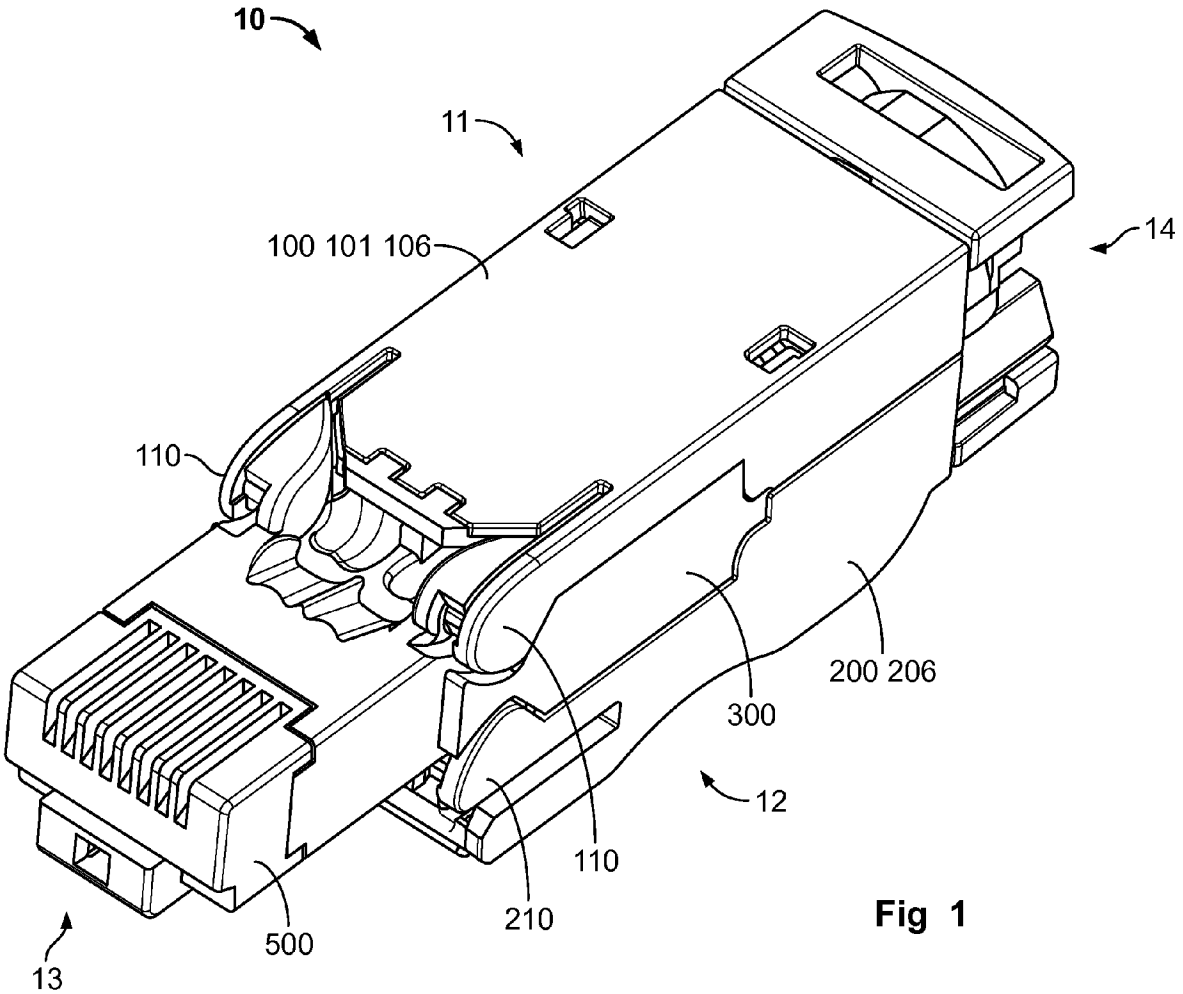
FIG. 1 is a perspective view of a top side of an electrical connector according to the invention.

FIG. 1 shows an electrical connector 10 according to an embodiment of the invention. The electrical connector 10 has a top side 11, a bottom side 12, a plug-in side 13, and a cable side 14. The cable side 14 is at an end opposite the plug-in side 13. The electrical connector 10 may be made as an RJ45 connector. In a further exemplary embodiment, the electrical connector 10 can transmit data according to the CAT 6A standard.

The electrical connector 10 includes a plurality of termination clamps 20, an upper cover part 100, a lower cover part 200, a middle housing part 300, electrically insulating elements 400, a connecting part 500, a circuit board 600, and a cable 700. The major components of the electrical connector 10 will now be described in greater detail.

Figure 10:
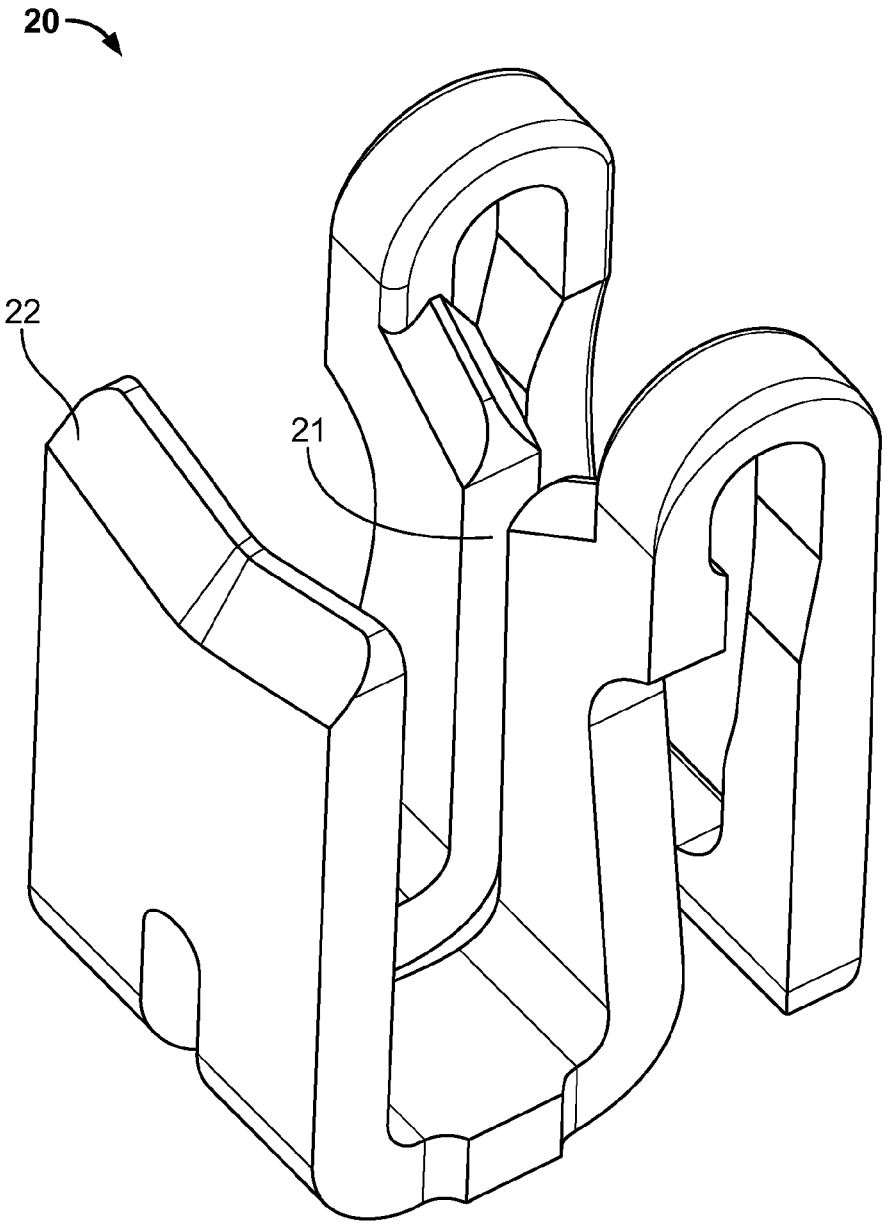
FIG. 10 is a perspective view of a termination clamp of an electrical connector according to the invention.

FIG. 10 shows a termination clamp 20. Termination clamp 20 is formed from an electrically conductive material, for example, the termination clamp 20 can be produced from sheet metal. The termination clamp 20 is slotted and twice S-shape folded. In the middle area of the termination clamp 20, a first blade portion 21 is disposed between two bars of the slotted blade clamp 20 extending in parallel. At one longitudinal end of the termination clamp 20, a second blade portion 22 is disposed.

Figure 8:
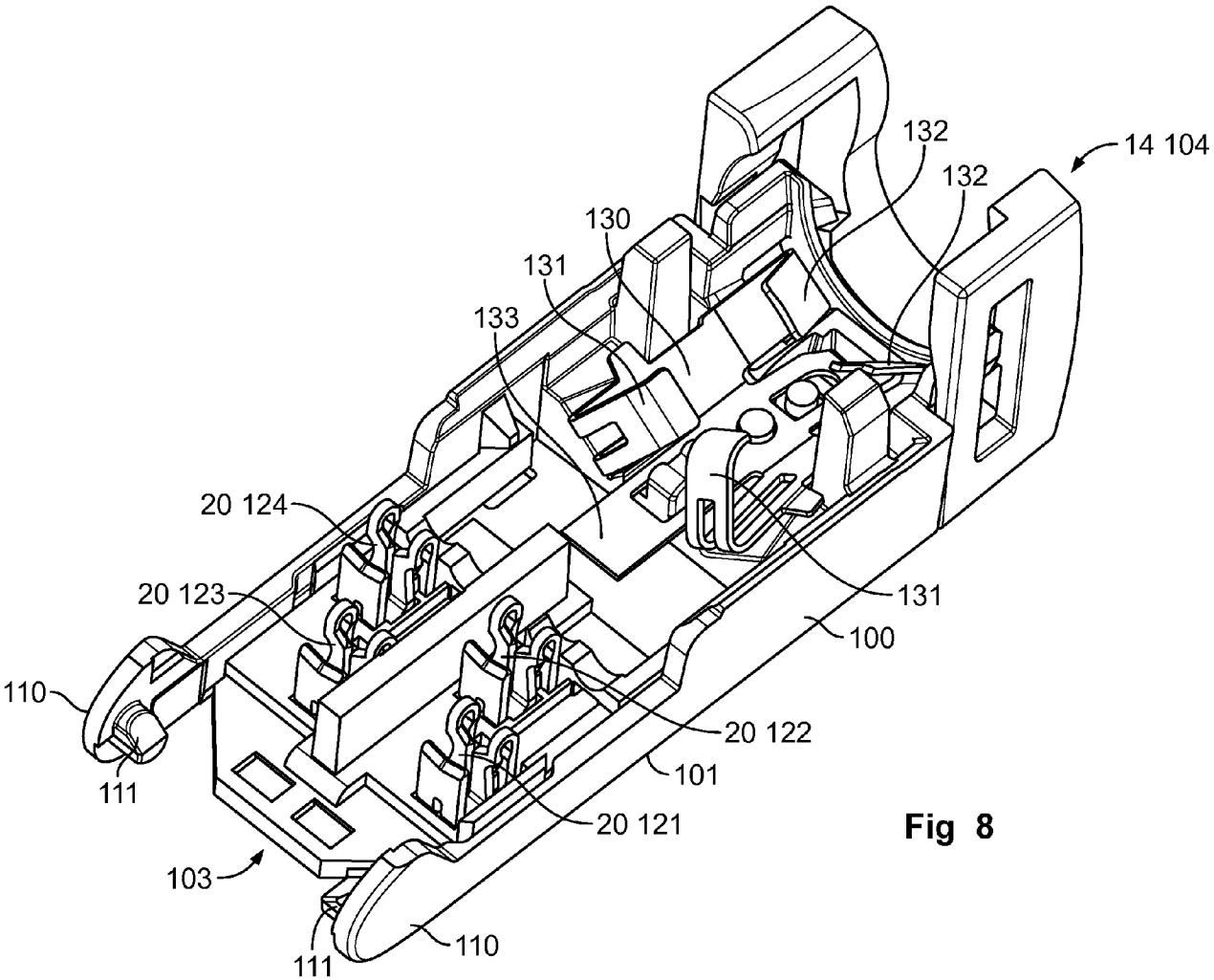
FIG. 8 is a perspective view of the upper cover part of an electrical connector according to the invention.

FIG. 8 shows the upper cover part 100 of the electrical connector 10. An internal side 102 of the upper cover part 100 is apparent, which is located opposite the external side 101 of the upper cover part 100 visible in FIG. 1.

On the internal side 102 of the upper cover part 100, four mutually identical termination clamps 20 are arranged, which are designated as first upper termination clamp 121, second upper termination clamp 122, third upper termination clamp 123, and fourth upper termination clamp 124.

On the joint side 103 of the upper cover part 100, two pivot pins 111 are made forming one part of an upper joint 110.

On the cable side 104 of the upper cover part 100, on the internal side 102, a shield clamp 130 is arranged. The shield clamp 130 may be formed from electrically conductive material, e.g. sheet metal. The shield clamp 130 has two internal friction springs 131 and two external friction springs 132. The internal friction springs 131 are arranged on the side facing the joint side 103 of the shield clamp 130. The external friction springs 132 are arranged on the side of the shield clamp 130 facing the cable side 104. The friction springs 131, 132 protrude from the internal side 102 and are elastically deformable. Between both internal friction springs 131, a contact stud 133 is made. The internal friction springs 131, the external friction springs 132, and the contact stud 133 are all connected together in an electrically conductive manner.

Figure 9:
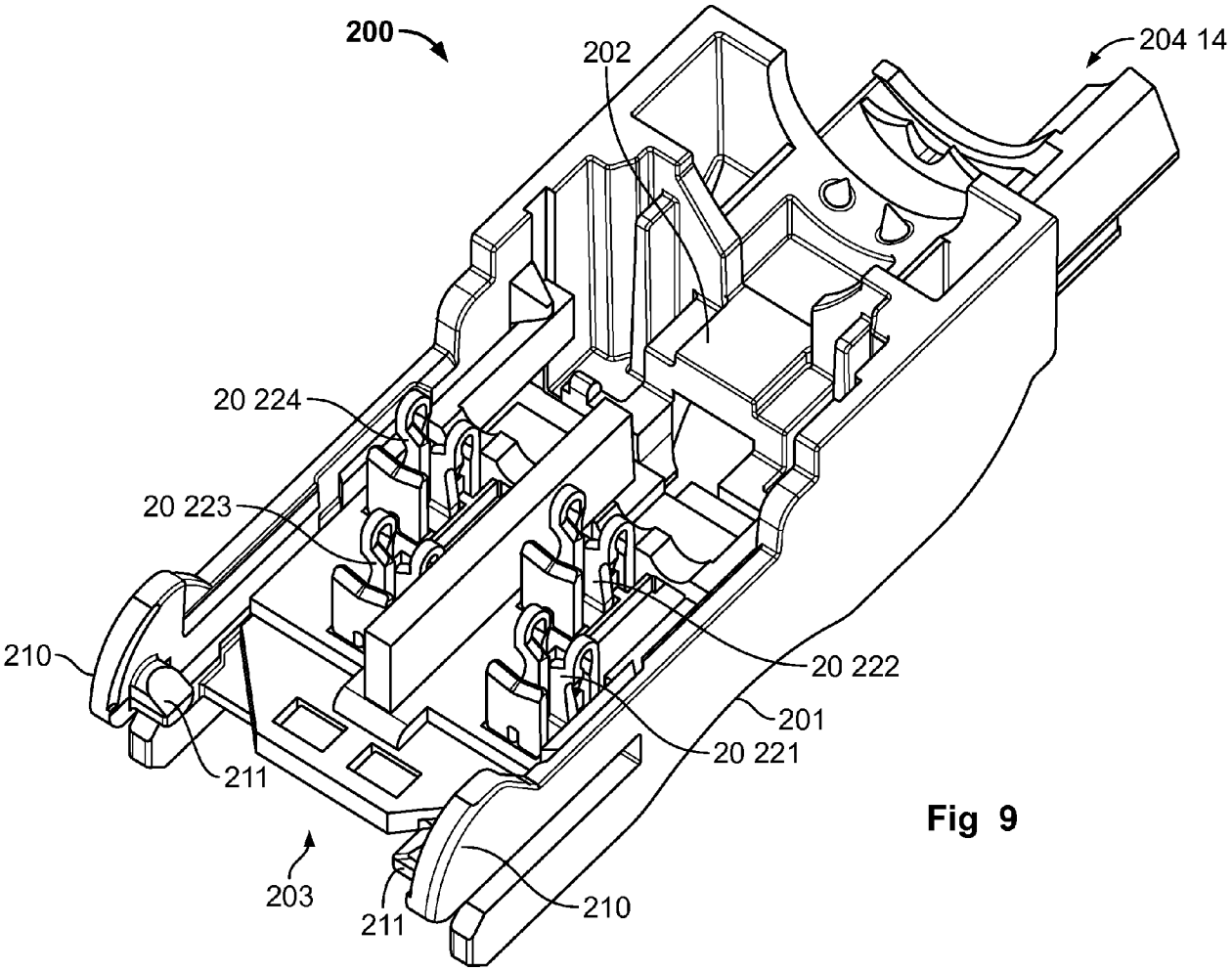
FIG. 9 is a perspective view of the lower cover part of an electrical connector according to the invention.

FIG. 9 shows the lower cover part 200 of the electrical connector 10. An internal side 202 of the lower cover part 200 can be seen which is located opposite the external side 201 of the lower cover part 200 visible in FIG. 2.

Figure 2:
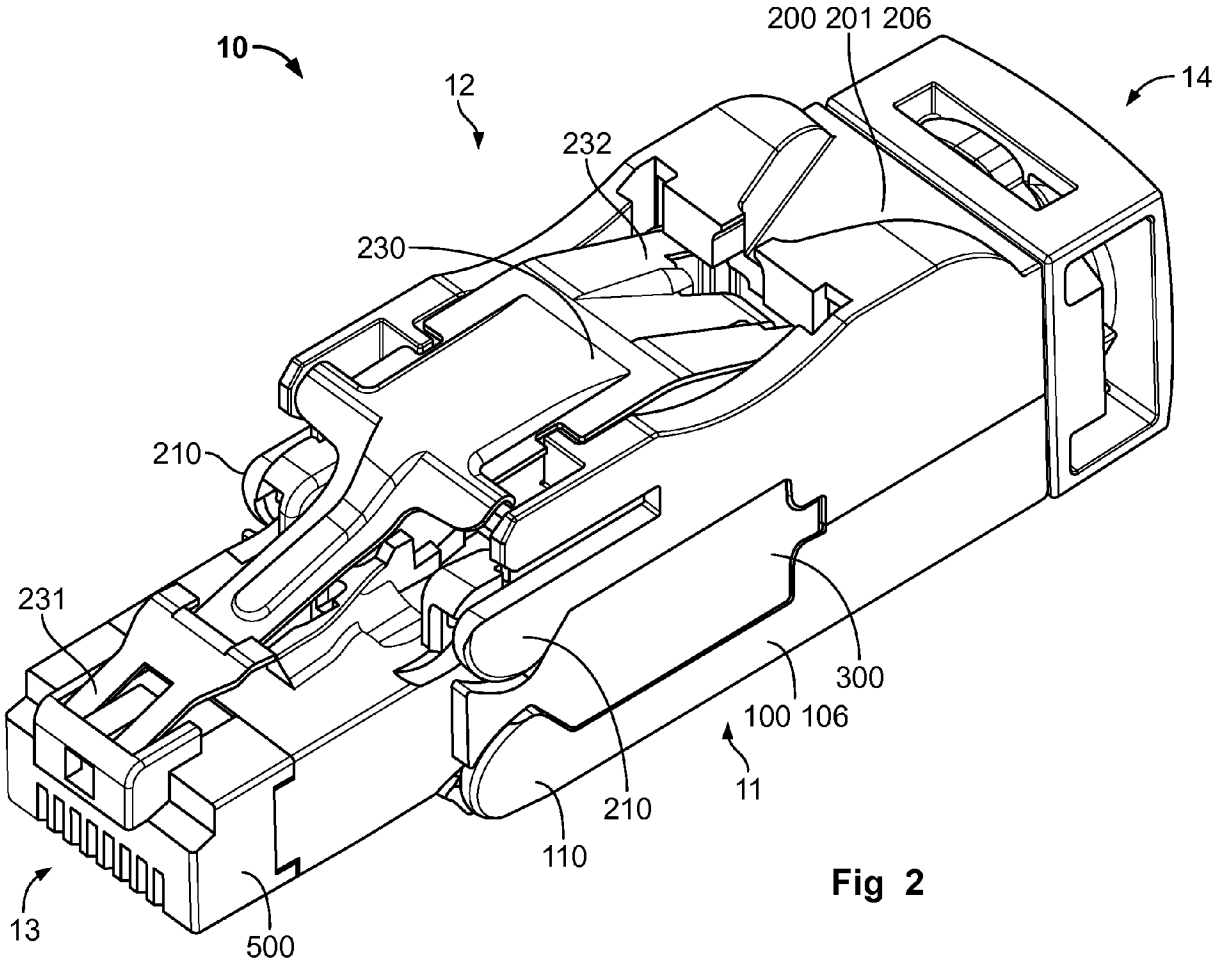
FIG. 2 is a perspective view of a bottom side of the electrical connector of FIG. 1.
Figure 17:
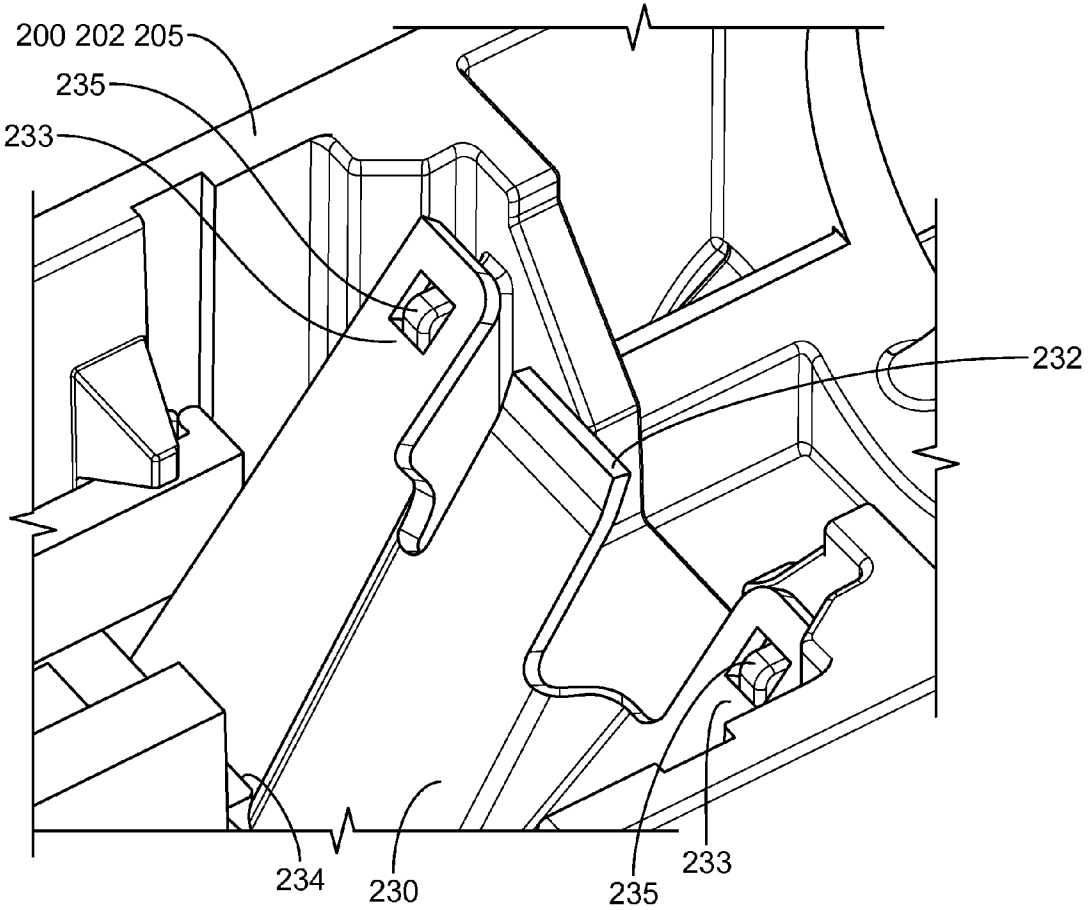
FIG. 17 is an enlarged perspective view of a portion of FIG. 16.

The lower cover part 200 also includes a retaining spring 230, as shown in FIG. 2, with a first longitudinal end 231 and a second longitudinal end 232. At the second longitudinal end 232 of the retaining spring 230, as shown in FIG. 17, two snap-in tongues 233 are made. On the internal side 202 of the lower cover part 200, two detents 235 are made.

The lower cover part 200 has a joint side 203 and a cable side 204 opposite the joint side 203. On the joint side 203 of the lower cover part 200, two pivot pins 211 are made forming parts of the lower joint 210.

On the internal side 202 of the lower cover part 200, four further termination clamps 20 are arranged, which are designated as first lower termination clamp 221, second lower termination clamp 222, third lower termination clamp 232, and fourth lower termination clamp 224.

Figure 3:
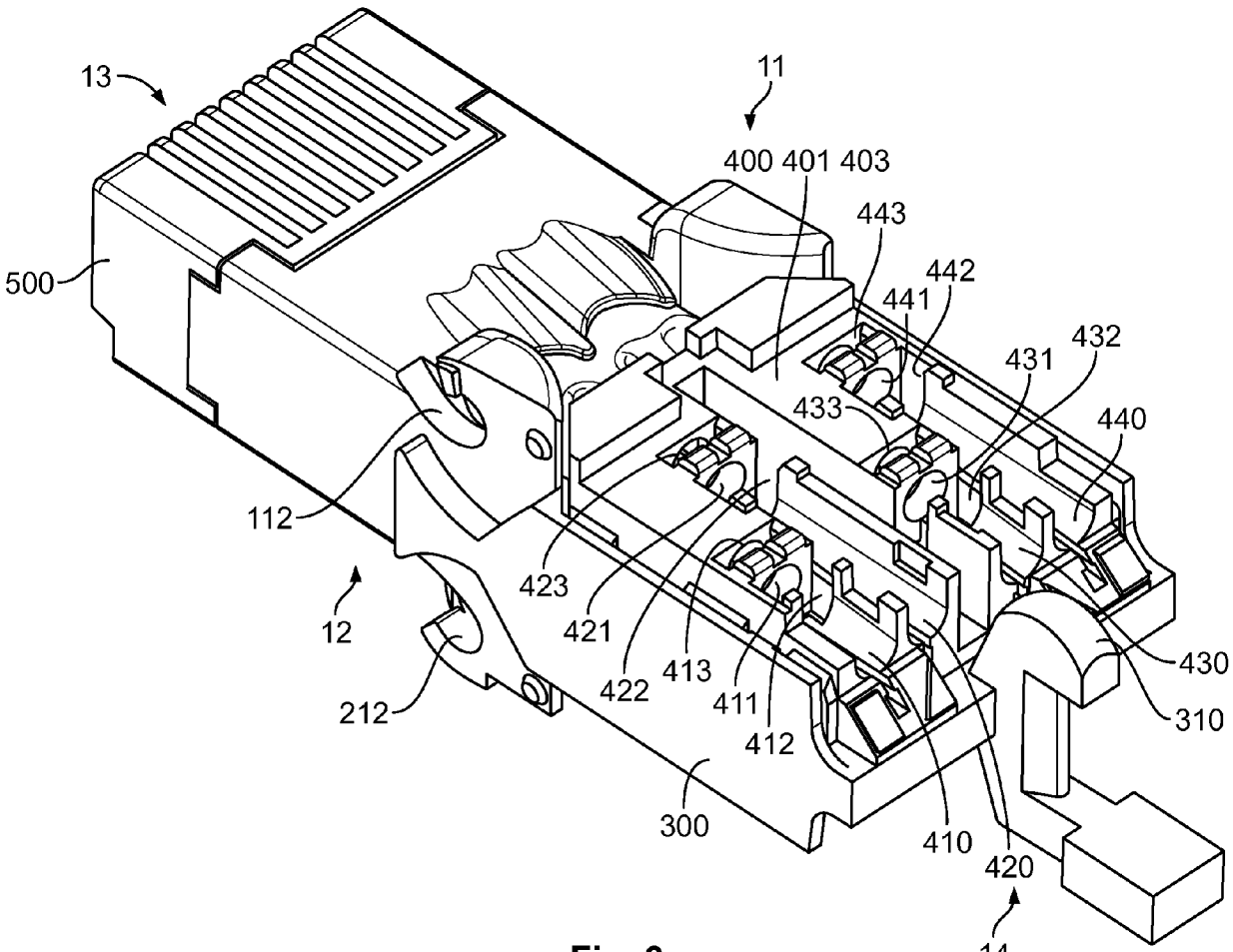
FIG. 3 is a perspective view of the top side of the electrical connector of FIG. 1.
Figure 6:
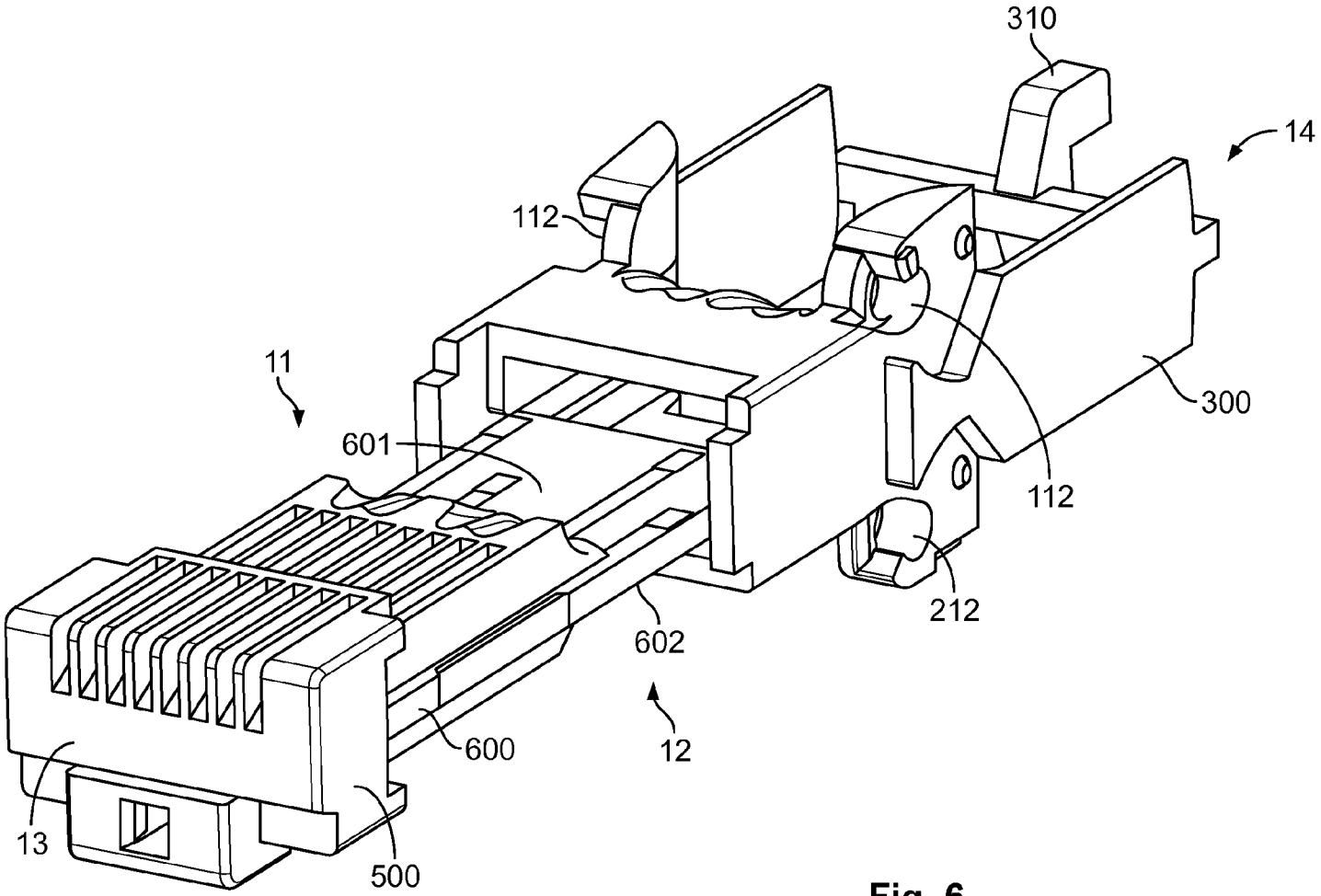
FIG. 6 is a perspective view of a middle housing part of an electrical connector according to the invention.

FIGS. 3 and 6 show the middle housing part 300 of the electrical connector 10. Close to the top side 11, the middle housing part 300 has two knuckle eyes 112. Similarly, close to the bottom side 12 of the electrical connector 10, the middle housing part 300 has two knuckle eyes 212.

On the cable side 14 of the middle housing part 300, a contact anchor 310 is made. Just like other portions of the middle housing part 300, the contact anchor 310 is made of electrically conductive material, for example, metal. The middle housing part 300 of the electrical connector 10 has two electrically insulating elements 401, 402.

Figure 4:
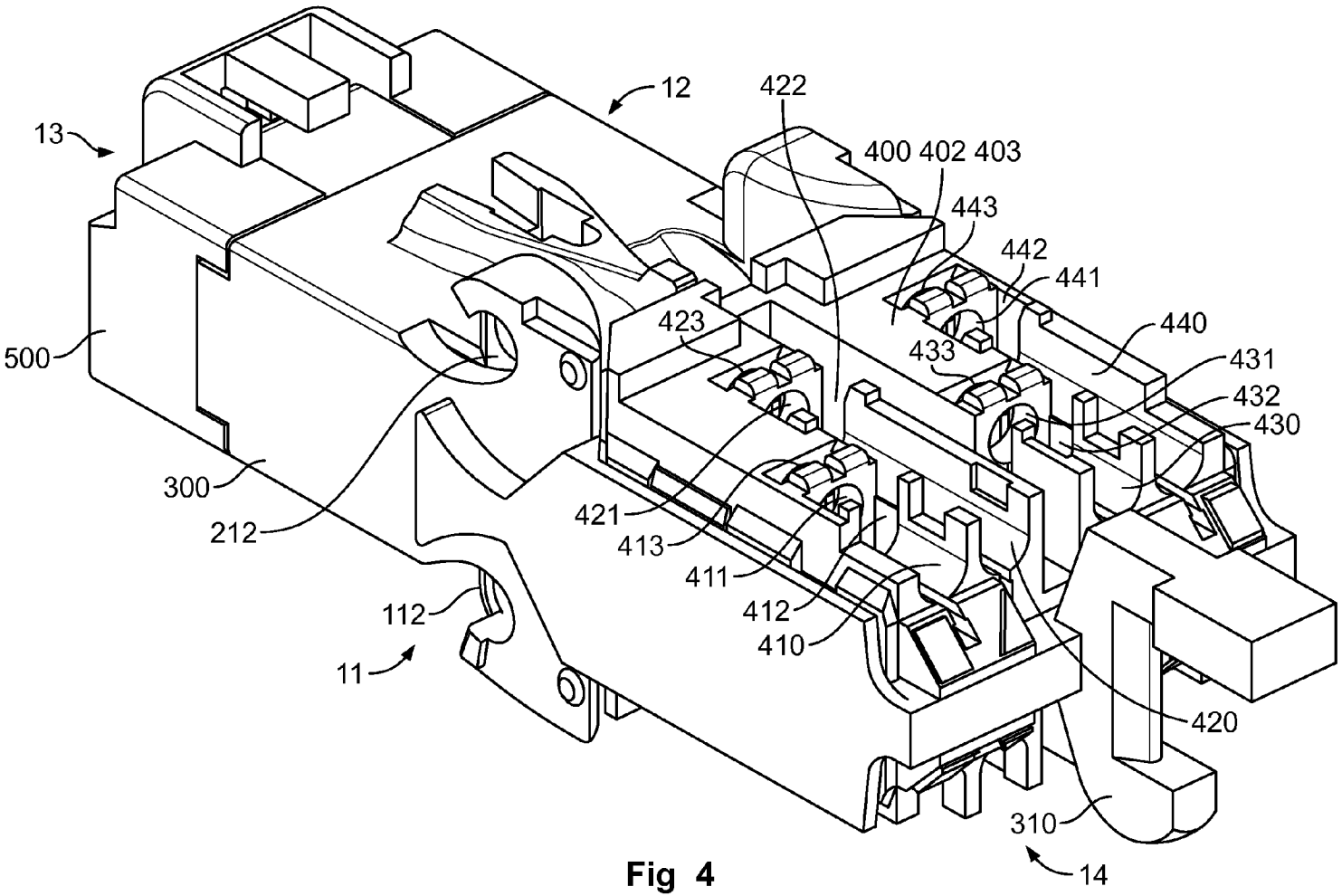
FIG. 4 is a perspective view of the bottom side of the electrical connector of FIG. 1.

The electrically insulating elements 400, as shown in FIGS. 3 and 4, have electrically insulating material, for example, a plastic material. The electrically insulating elements 400 can also be designated as cable managers.

Figure 7:
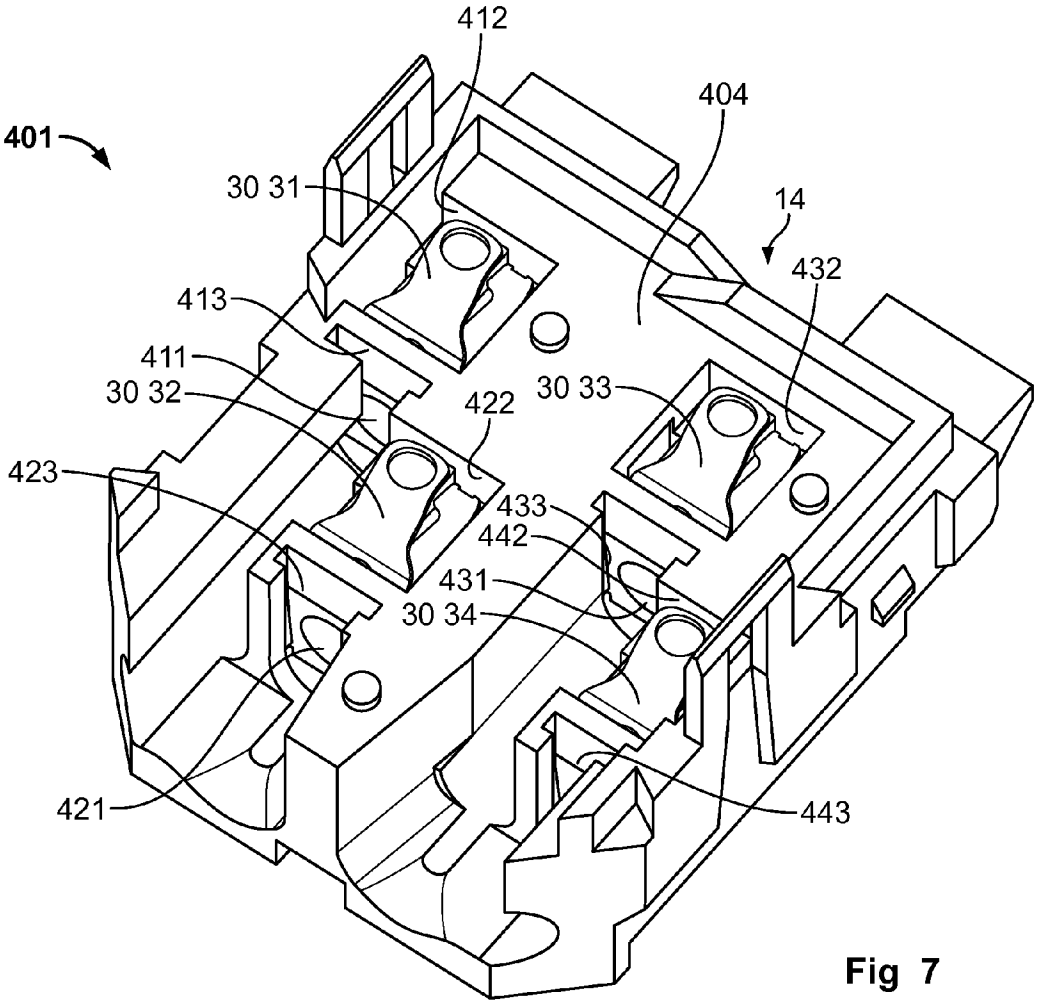
FIG. 7 is a perspective view of an electrically insulating element of an electrical connector according to the invention.

In FIGS. 3 and 7, a first electrically insulating element 401 can be seen. An external side 403 of the first electrically insulating element 401 is apparent. The first electrically insulating element 401 has four core guides which are made as grooves extending in parallel to a longitudinal direction extending between the plug-in side 13 and the cable side 14 of the electrical connector 10. Adjacently, a first core guide 410, a second core guide 420, a third core guide 430, and a fourth core guide 440 are arranged. The first core guide 410 has a first core opening 411 oriented perpendicularly to the groove portion of the first core guide 410. In the direction of the cable side 14 of the electrical connector 10 in front of the first core opening 411, a first termination clamp pocket 412 is arranged. In the direction of the plug-in side 13 of the electrical connector 10, behind the first core opening 411, a first blade pocket 413 is made. The first termination clamp pocket 412 and the first blade pocket 413 are respectively made as openings in the first electrically insulating element 401, which extend from the external side 403 of the first electrically insulating element 401 through the first electrically insulating element 401. The second core guide 420 has a second core opening 421, a second termination clamp pocket 422, and a second blade pocket 423. The third core guide 430 has a third core opening 431, a third termination clamp pocket 432, and a third blade pocket 433. The fourth core guide 440 has a fourth core opening 441, a fourth termination clamp pocket 442, and a fourth blade pocket 443. The core openings 421, 431, 441, the termination clamp pockets 422, 432, 442, and the blade pockets 423, 433, 443 are made like the first core opening 411, the first termination clamp pocket 412, and the first blade pocket 413.

FIG. 7 shows the first electrically insulating element 401 of the electrical connector 10 in greater detail. In the view of FIG. 7, an internal side 404 of the first electrically insulating element 401 can be seen, which is located opposite the external side 403 of the first electrically insulating element 401 visible in FIG. 3. The internal side 404 of the second electrically insulating element 402 is made analogously.

In FIG. 7, the first blade pocket 413, the second blade pocket 423, the third blade pocket 433, and the fourth blade pocket 443 can be seen as extending from the external side 403 to the internal side 404 of the first electrically insulating element 401. Furthermore, the first core opening 411, the second core opening 421, and the third core opening 431 can be seen.

In the first termination clamp pocket 412, the second termination clamp pocket 422, the third termination clamp pocket 432, and the fourth termination clamp pocket 442, which also respectively extend from the external side 403 to the internal side 404 of the first electrically insulating element 401, respectively one contact spring 30 is arranged. In the first termination clamp pocket 412, a first contact spring 31 is arranged. In the second termination clamp pocket 422, a second contact spring 32 is arranged. In the third termination clamp pocket 432, a third contact spring 33 is arranged. In the fourth termination clamp pocket 442, a fourth contact spring 34 is arranged. The contact springs 30, 31, 32, 33, 34 respectively have electrically conductive material, e.g. sheet metal. The contact springs 30 are made to be elastically deformable.

In FIG. 4, a second electrically insulating element 402 of the electrical connector 10 is apparent. The second electrically insulating element 402 preferably is made identically to the first electrically insulating element 401. The external side 403 of the second electrically insulating element 402 is facing in the same direction as the bottom side 12 of the electrical connector 10. Also, the second electrically insulating element 402 has four core guides 410, 420, 430, 440 with respectively one core opening 411, 421, 431, 441, a first termination clamp pocket 412, 422, 432, 442, and a blade pocket 413, 423, 433, 443.

Figure 5:
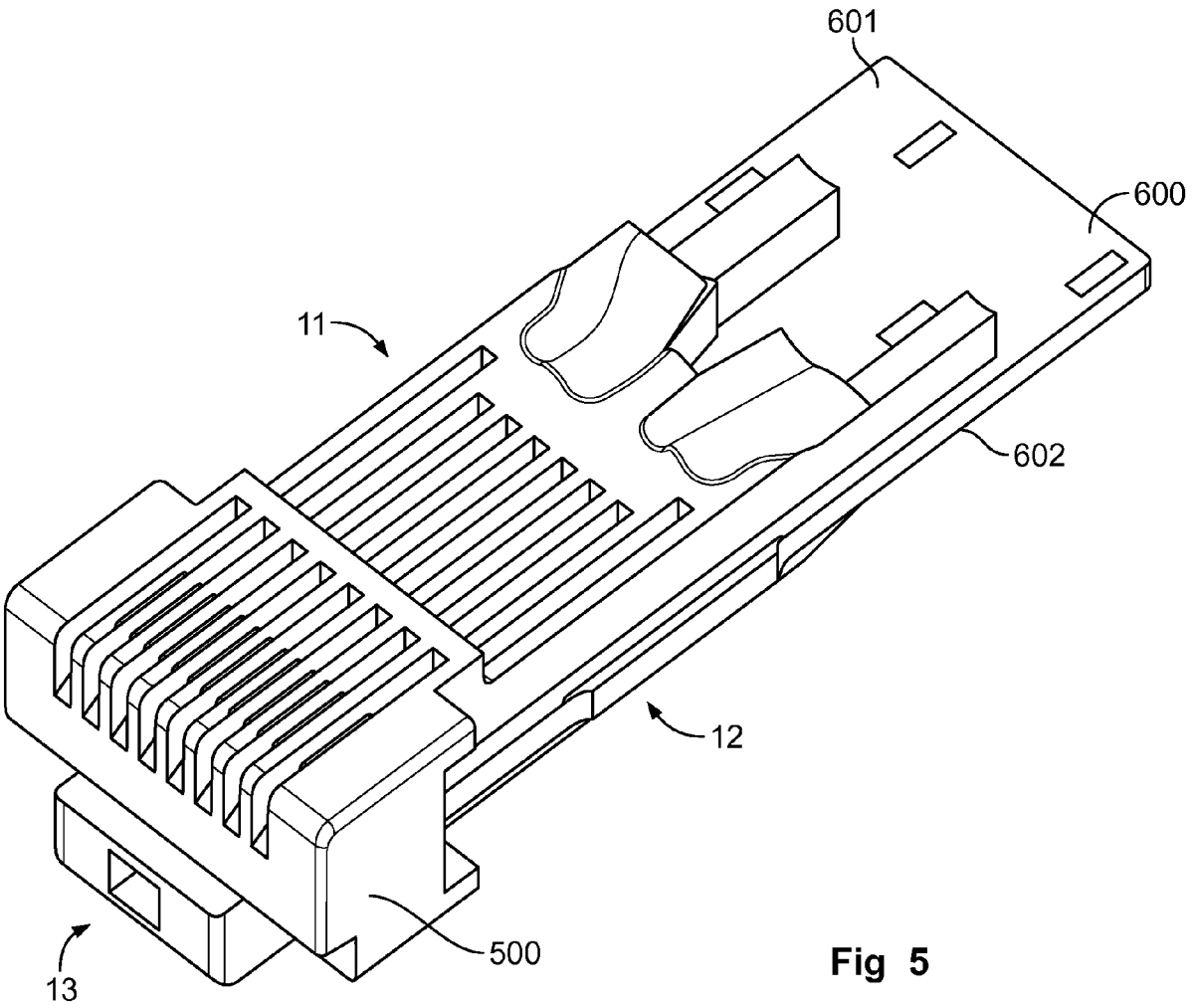
FIG. 5 is a perspective view of a connecting part and a circuit board of an electrical connector according to the invention.

FIGS. 5 and 6 show the connecting part 500 and a circuit board 600 of the electrical connector 10.

The connecting part 500 has electrical contact elements (not shown). The electrical contact elements of the connecting part 500 are arranged at the longitudinal end of the connecting part 500 forming the plug-in side 13 of the electrical connector 10.

The circuit board 600 has a top side 601 and a bottom side 602 opposite the top side 601. On the top side 601 and bottom side 602, respectively, at least four electrically conductive tracks (not shown) are arranged which are electrically insulated from each other.

Between the top side 601 and bottom side 602 thereof, the circuit board 600 may have a metal layer for shielding the tracks arranged on the top side 601 from tracks arranged on the bottom side 602. The metal layer is then electrically insulated both from the tracks arranged on the top side 601 and on the bottom side 602. However, the metal layer can also be omitted.

Figure 13:
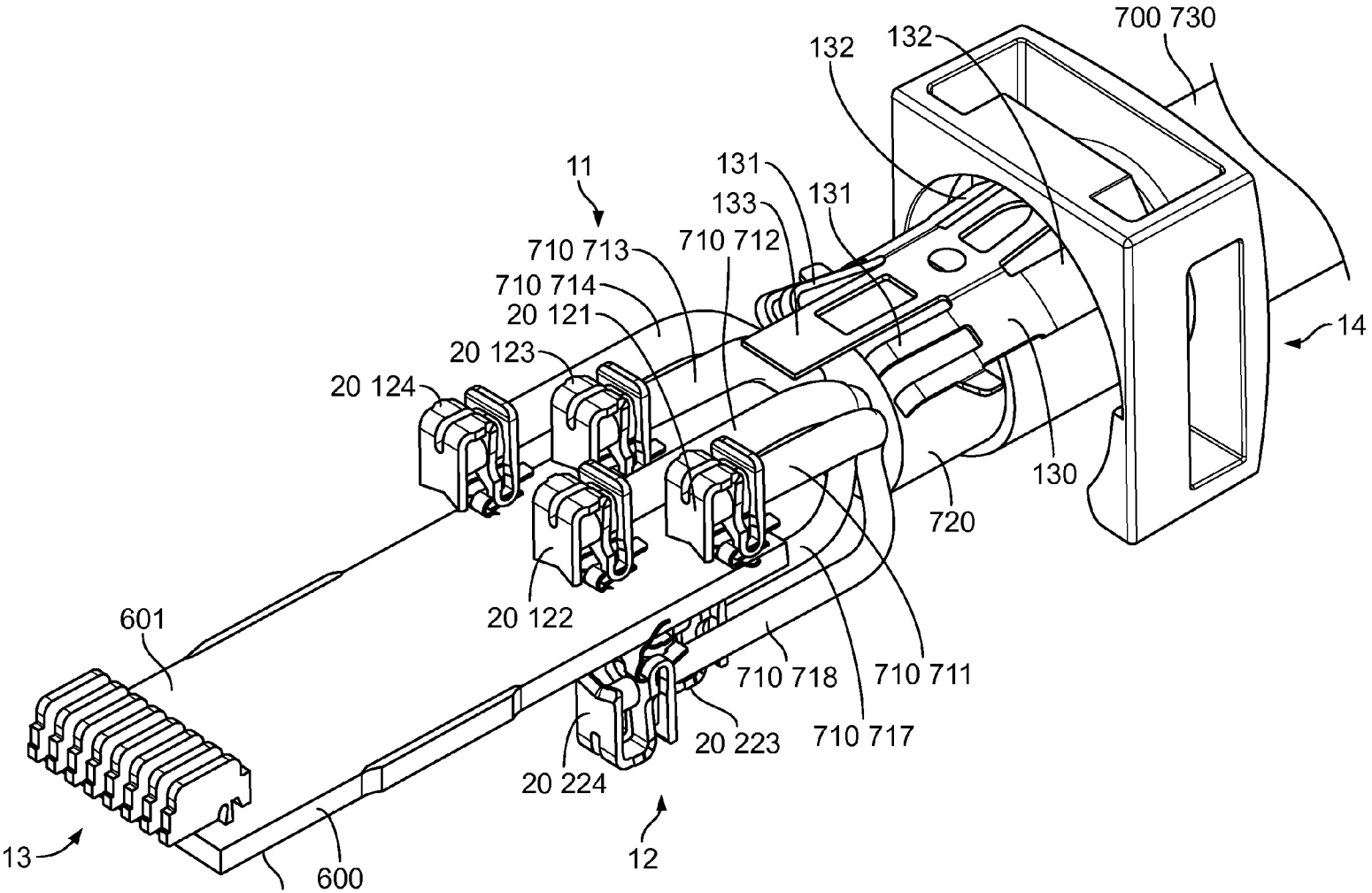
FIG. 13 is a perspective view of the electrical connector of FIG. 1.
Figure 14:
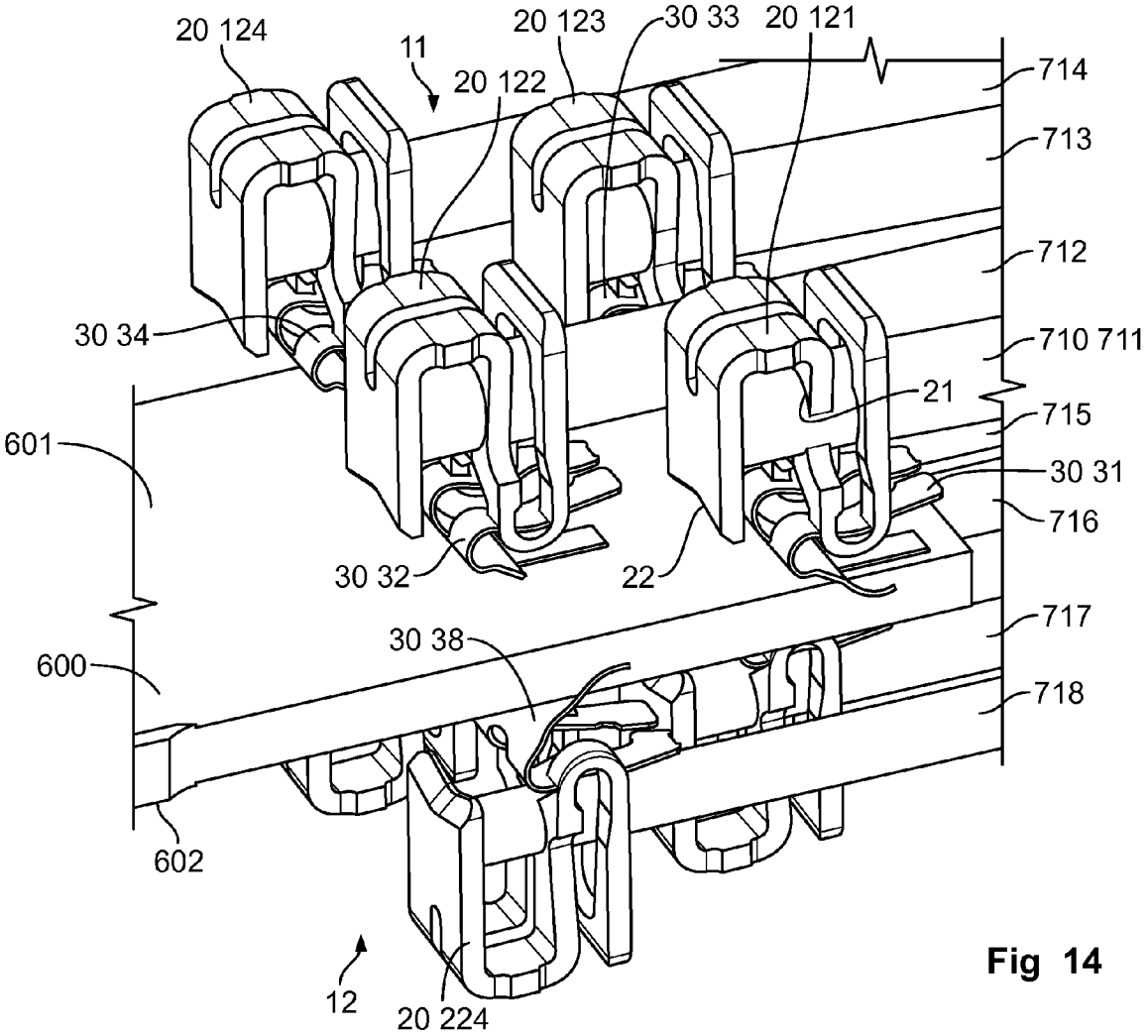
FIG. 14 is an enlarged perspective view of a portion of FIG. 13.

FIGS. 13 and 14 show a cable 700 fed to the electrical connector 10 from the cable side 14. The cable 700 may be a cable for transmitting electrical data signals. For example, the cable 700 can be a cable according to the CAT 6A standard. The cable 700 has a plurality of cores 710, designated as first core 711, second core 712, third core 713, fourth core 714, fifth core 715, sixth core 716, seventh core 717, and eighth core 718. Each of said cores 710 has an electrically conductive wire surrounded by a core insulation. The cores 710 of the cable 700 are together enveloped by a shield 720 of the cable 700. The shield 720 has electrically conductive material and can be made as braiding, for example. The shield 720 in turn can be enveloped by an electrically insulating sheath 730.

The cores 711 to 718 can be spaced apart in pairs by means of a star-shaped insulating piece arranged between the cores 711 to 718. Said star-shaped insulating piece is not represented in FIGS. 13 and 14.

At a longitudinal end of the cable 700 facing the electrical connector 10, the sheath 730 and the shield 720 have been partially removed so that in a first longitudinal portion, the cores 710 of the cable 700 are exposed, and in a second longitudinal portion, the shield 720 of the cable 700 is exposed.

The connections forming the electrical connector 10 will now be described in greater detail.

As shown in FIGS. 1 and 2, the upper cover part 100 is intended to be arranged at the middle housing part 300 of the electrical connector 10 so that a joint side 103 of the upper cover part 100 is facing in the direction of the plug-in side 13 of the electrical connector 10, while a cable side 104 of the upper cover part 100 is facing in the direction of the cable side 14 of the electrical connector 10. The external side 101 faces away from the middle housing part 300 and forms one part of the top side 11 of the electrical connector 10. The upper cover part 100 is hingedly and pivotingly secured to the middle housing part 300 via the upper joint 110.

When the lower cover part 200 is connected to the middle housing part 300 of the electrical connector 10, the joint side 203 is facing in the direction of the plug-in side 13 of the electrical connector 10, while the cable side 204 of the lower cover part 200 is facing in the direction of the cable side 14 of the electrical connector 10. The lower cover part 200 is hingedly and pivotingly secured to the middle housing part 300 by means of the lower joint 210.

On the bottom side 12 of the electrical connector 10, the retaining spring 230 is arranged. The first longitudinal end 231 of the retaining spring 230 is secured to the connecting part 500 of the electrical connector 10. The second longitudinal end 232 of the retaining spring 230 is secured to the lower cover part 200. The retaining spring 230 extends over one part of the external side 201 of the lower cover part 200.

As shown in FIG. 3, the first electrically insulating element 401 is arranged on the top side 11 of the middle housing part 300. As shown in FIG. 4, the second electrically insulating element 402 is arranged on the bottom side 12 of the middle housing part 300.

As shown in FIGS. 5 and 6, the circuit board 600 is connected to the connecting part 500 so that electrically conductive connections exist between the tracks of the circuit board 600 and electrical contact elements of the connecting part 500. Thus, electrically conductive connections exist between electrical contacts of the connector counterpart and the tracks arranged on the top side 601 and bottom side 602 of the circuit board 600.

From FIG. 6, it is apparent that the middle housing part 300, the connecting part 500, and the circuit board 600 in the mounted state of the electrical connector 10 are connected together so that in the area of the middle housing part 300, the circuit board 600 is located between the first electrically insulating element 401 and the second electrically insulating element 402.

Figure 11:
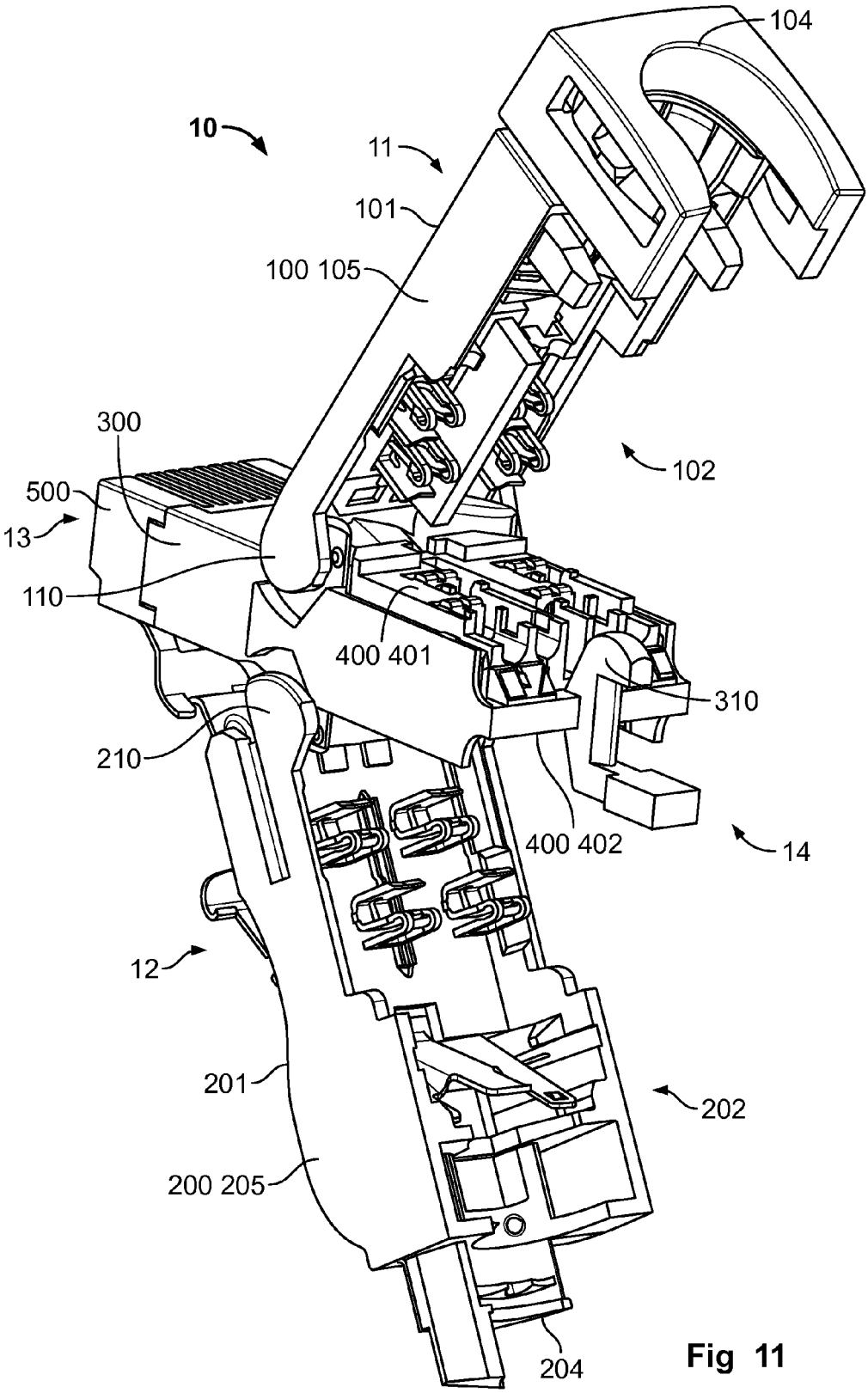
FIG. 11 is a perspective view of the electrical connector of FIG. 1.
Figure 12:
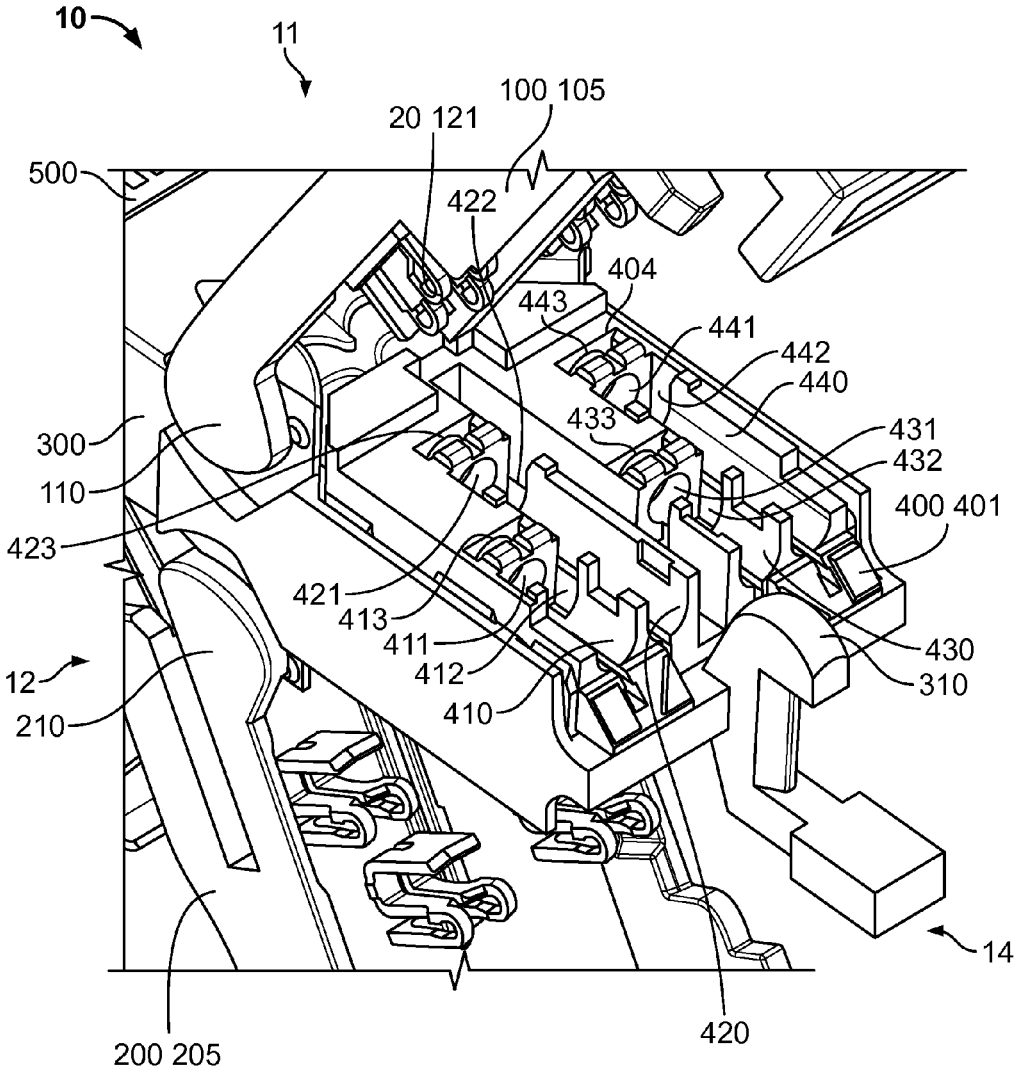
FIG. 12 is an enlarged perspective view of a portion of FIG. 11.

In FIGS. 1 and 2, the upper cover part 100 is represented in a closed position 106, and the lower cover part 200 is represented in a closed position 206. In both FIGS. 11 and 12, the upper cover part 100 is in an open position 105, and the lower cover part 200 is in an open position 205. In the open position 105, the upper cover part 100 is pivoted about the upper joint 110 with respect to the middle housing part 200 so that the cable side 104 of the upper cover part 100 is spaced apart from the middle housing part 300. The lower cover part 200 is pivoted in the open position 206 about the lower joint 210 with respect to the middle housing part 300 so that the cable side 204 of the lower cover part 200 is spaced apart from the middle housing part 300.

In the open position 105 of the upper cover part 100, four cores of the cable 700 can be placed into the core guides 410, 420, 430, 440 of the first electrically insulating element 401. For this purpose, the longitudinal ends of the cores are plugged into the core openings 411, 421, 431, 441 from the cable side 14 of the electrical connector 10. Next, the upper cover part 100 can be moved from the open position 105 into the closed position 106 thereof so as to electrically connect the cores arranged within the core guides 410, 420, 430, 440 to the electrical connector 10.

In the open position 205 of the lower cover part 200, four further cores of a cable can be placed into the core guides 410, 420, 430, 440 of the second electrically insulating element 402 by inserting said cores from the cable side 14 of the electrical connector 10 into the core openings 411, 421, 431, 441. Next, the lower cover part 200 can be pivoted from the open position 205 into the closed position 206 thereof, so as to connect the cores arranged within the core guides 410, 420, 430, 440 of the second electrically insulating element 402 to the electrical connector 10 in an electrically conductive manner.

When the upper cover part 100 is moved from the open position 105 into the closed position 106, the termination clamps 121, 122, 123, 124 arranged on the internal side 102 of the upper cover part 100 engage with the core guides 410, 420, 430, 440 of the first electrically insulating element 401 so that the cutting portion 21 of the first upper termination clamp 121 is received in the first termination clamp pocket 412 while the blade portion 22 of the first upper termination clamp 121 is received in the first blade pocket 413. Accordingly, the cutting portions 21 and the blade portions 22 of the further upper termination clamps 122, 123, 124 are received in the further cutting clamp pockets 422, 432, 442 and blade pockets 423, 433, 443 of the first electrically insulating element 401.

When the lower cover part 200 is moved from the open position 205 into the closed position 206, the lower termination clamps 221, 222, 223, 224 arranged on the internal side 202 of the lower cover part 200 accordingly engage the core guides 410, 420, 430, 440 of the second electrically insulating element 402 so that the cutting portions 21 of the lower termination clamps 221, 222, 223, 224 are received in the cutting clamp pockets 412, 422, 432, 442 of the second electrically insulating element 402 and the blade portions 22 of the lower termination clamps 221, 222, 223, 224 are received in the blade pockets 413, 423, 433, 443 of the second electrically insulating element 402.

FIG. 13 shows a perspective and partially open view of the electrical connector 10 after closing of the upper cover part 100 and lower cover part 200. In the view of FIG. 13, some parts of the upper cover part 100, the lower cover part 200, and the middle housing part 300 are not represented in order to enable viewing of the internal components of the electrical connector 10. FIG. 14 shows an enlarged view of a middle portion of the electrical connector 10.

The external friction springs 132 of the shield clamp 130 of the electrical connector 10 resiliently press the sheath 730 of the cable 700, thereby fixing the cable 700 to the electrical connector 10, and cause strain relief for the cable 700. In the portion of the cable 700 where the shield 720 of the cable 700 is exposed, the internal friction springs 131 of the shield clamp 130 of the electrical connector 10 resiliently press the shield 720 of the cable 700. Thereby, an electrically conductive connection exists between the shield 720 and the shield clamp 130.

The first core 711 of the cable 700 guided in the first core guide 410 of the first electrically insulating element 401 is contacted by the first upper termination clamp 121 arranged on the internal side 102 of the upper cover part 100 in an electrically conductive manner and connected via the first upper termination clamp 121 in an electrically conductive manner to the first contact spring 31 of the first electrically insulating element 401. Via the first contact spring 31, the first core 711 is then connected to a first track on the top side 601 of the circuit board 600. Via said track on the top side 601 of the circuit board 600, the first core 711 is connected in an electrically conductive manner to a contact element of the electrical connector 10 in the connecting part 500 on the plug-in side 13 of the electrical connector 10.

While the upper cover part 100 is in the open position 105, the first core 711 of the cable 700 is placed into the first core guide 410 of the first electrically insulating element 401 and thus plugged into the first core opening 411 of the first electrically insulating element 401. When the upper cover part 100 is pivoted from the open position 105 into the closed position 106, the blade portion 22 of the first upper termination clamp 121 has penetrated into the first blade pocket 413 of the first electrically insulating element 401 and has severed the first core 711 in the area of the first blade pocket 413. At the same time, the cutting portion 21 of the first upper termination clamp 121 has penetrated into the first termination clamp pocket 412 of the first electrically insulating element 401 and has electrically contacted the first core 711 in the area of the first termination clamp pocket 412. Moreover, upon pivoting of the upper cover part 100 from the open position 105 into the closed position 106, the first upper termination clamp 121 has made contact with the first contact spring 31 in the first termination clamp pocket 412 of the first electrically insulating element 401 and now pushes the same resiliently against the first track on the top side 601 of the circuit board 600.

Due to severing of the first core 711 by means of the blade portion 22 of the first upper termination clamp 121, the first core 711 has a length very well adapted for contacting by the first upper termination clamp 121. Due to the first upper termination clamp 121 and the first contact spring 31 being made as separate parts, the first upper termination clamp 121 can advantageously have a robust configuration with high material thickness while the first contact spring 31 can advantageously have a simple elastically deformable shape of thinner material thickness. Furthermore, due to cooperation of the first upper termination clamp 121 and the first contact spring 31, the first upper termination clamp 121 and the first contact spring 31 can respectively be designed with shorter overall length, whereby they may have beneficial high frequency transmission properties.

Similarly to the first core 711 of the cable 700, the second core 712 of the cable 700 is cut and electrically contacted by the second upper termination clamp 121. Via the second upper termination clamp 122 and the second contact spring 32 of the first electrically insulating element 401, the second core 712 is in electrically conductive connection with a second track on the top side 601 of the circuit board 600. The third core 713 of the cable 700 protrudes beyond the third upper termination clamp 123 and the third contact spring 33 of the first electrically insulating element 401 in electrically conductive connection with a third track on the top side 601 of the circuit board 600. Via the fourth upper termination clamp 124 and the fourth contact spring 34 of the first electrically insulating element 401, the fourth core 714 is in electrically conductive connection with a fourth track on the top side 601 of the circuit board 600.

The fifth core 715, the sixth core 716, the seventh core 717, and the eighth core 718 of the cable 700 are arranged prior to moving the lower cover part 200 of the electrical connector 10 from the open position 205 into the closed position 206 within the core guides 410, 420, 430, 440 of the second electrically insulating element 402, and are cut to length and electrically contacted upon closing of the lower cover part 200 via the lower termination clamps 221, 222, 223, 224 of the lower cover part 200. In the closed position 206 of the lower cover part 200, the lower termination clamps 221, 222, 223, 224 are in electrically conductive connection with the respectively associated contact springs 30 of the second electrically insulating element 402 and push the same electrically onto tracks arranged on the bottom side 602 the circuit board 600. E.g., the eighth core 718 of the cable 700 is electrically contacted by the fourth lower termination clamp 224. The fourth lower termination clamp 224 pushes an eighth contact spring 38 of the second electrically insulating element 402 against an eighth track on the bottom side 602 of the circuit board 600.

It is not necessary to shorten the cores 710 of the cable 700 to an exactly dimensioned length prior to being connected with the electrical connector 10. Instead, the cores 710 of the cable 700 are simply plugged into the core openings 411, 421, 431, 441 of the first electrically insulating element 401 and the second electrically insulating element 402. When the upper cover part 100 and the lower cover part 200 are closed, the cores 710 are automatically shortened to an appropriate length by the blade portion 22 of the termination clamps 20. When the upper cover part 100 and lower cover part 200 have been closed, the cut ends of the cores 710 of the cable 700 can be extracted on the joint sides 103, 203 of the upper cover part 100 and the lower cover part 200.

Figure 15:
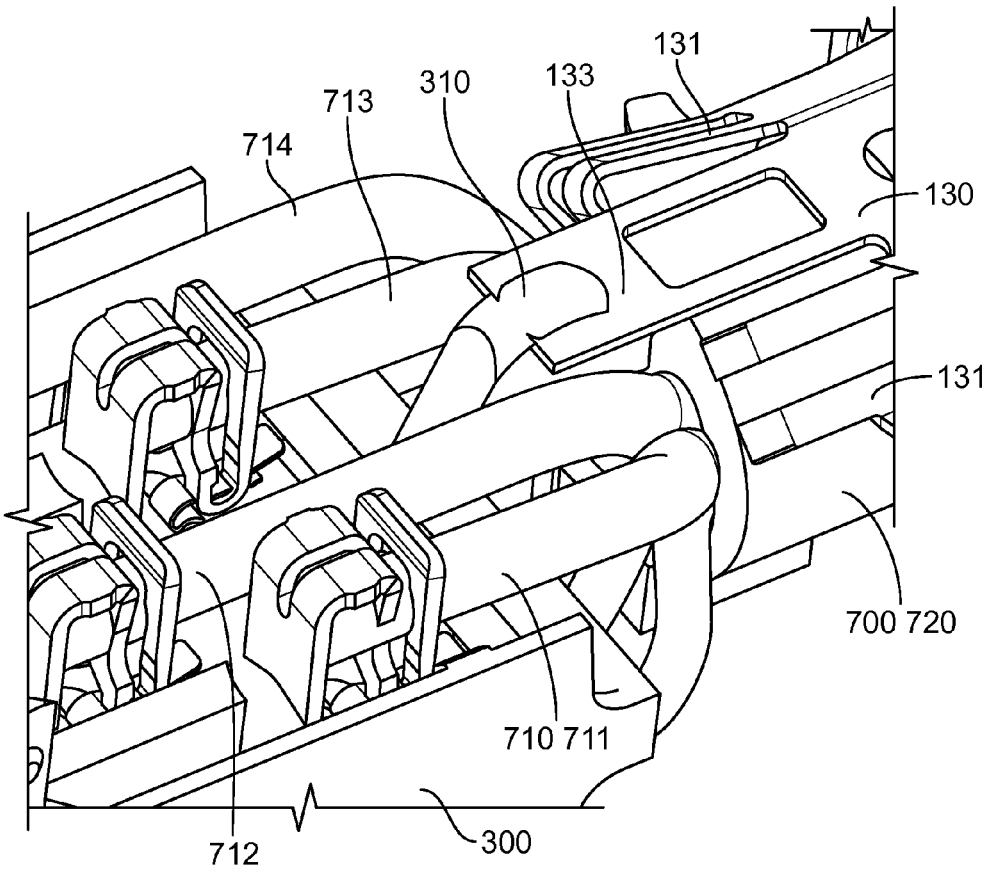
FIG. 15 is an enlarged perspective view of a portion of FIG. 13.

The upper cover part 100 of the electrical connector 10 is in the closed position 106 in FIG. 15. The internal friction springs 131 of the shield clamp 130 on the internal side 102 of the upper cover part 100 are pushed against the exposed shield 720 of the cable 700. Thus, the shield clamp 130 is in electrically conductive connection with the shield 720 of cable 700. The contact stud 133 of the shield clamp 130 is pushed against the contact anchor 310 of the middle housing part 300. Thereby, an electrically conductive connection exists between the middle housing part 300 of the electrical connector 10 and the shield clamp 130 and thus also an electrically conductive connection between the middle housing part 300 and the shield 720 of the cable 700. When the electrical connector 10 is plugged into an appropriate connector counterpart, there is also an electrically conductive connection between the middle housing part 300 of the electrical connector 10 and appropriate contact surfaces of the connector counterpart. Thus, interference pulses on the shield 720 of the cable 700 can be dissipated via the internal friction springs 131 and the contact stud 133 of the shield clamp 133 and the middle housing part 300 toward the connector counterpart. Thus, the electrical connector 10 has good EMC properties regarding wire-related interferences.

Figure 16:
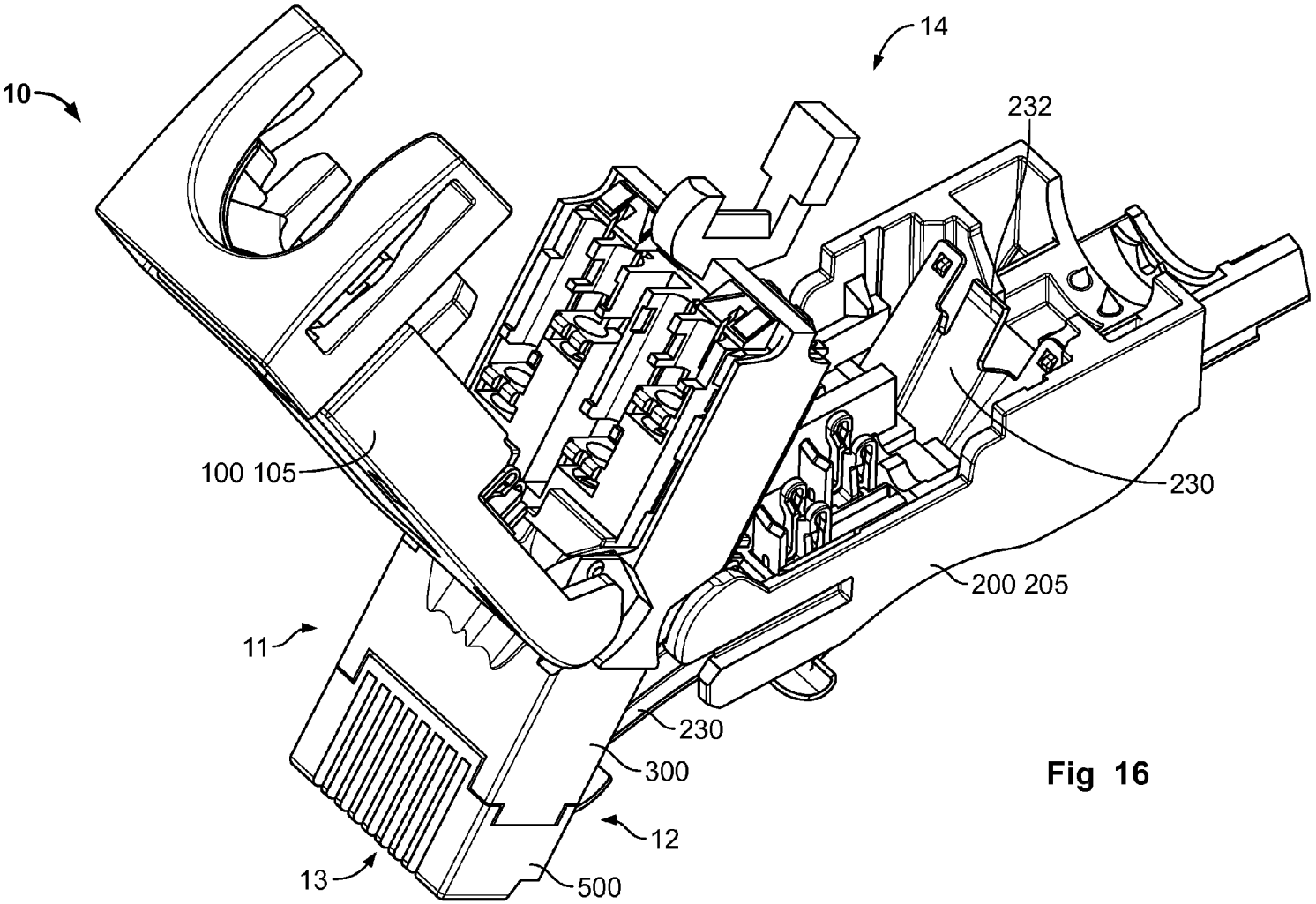
FIG. 16 is a perspective view of the electrical connector of FIG. 1.

FIG. 16 shows another perspective of the electrical connector 10. The upper cover part 100 is in the open position 105. The lower cover part 200 is in the open position 205. FIG. 17 shows an enlarged view of one part of the internal side 202 of the lower cover part 200 of the electrical connector 10 in the open position 205 of the lower cover part 200.

In the open position 205 of the lower cover part 200, retaining spring 230, arranged on the bottom side 12 of the electrical connector 10, extends through a slot 234 arranged in the lower cover part 200. The first longitudinal end 231 of the retaining spring 230 is fastened to the connecting part 500 of the electrical connector 10. Starting from the first longitudinal end 231 thereof, the retaining spring 230 first extends along the external side 201 of the lower cover part 200 and then through the slot 234 from the external side 201 of the lower cover part 200 to the internal side 202 of the lower cover part 200. The second longitudinal end 232 of the retaining spring 230 is arranged between the internal side 202 of the lower cover part 200 and the middle housing part 300.

In the open position 205 of the lower cover part 200, the snap-in tongues 233 at the second longitudinal end 232 of the retaining spring 230 are snapped into the detents 235 on the internal side 202 of the lower cover part 200. Thereby, the lower cover part 200 is maintained in the open position 205. Thus, placing the cores 710 of the cable 700 into the core guides 410, 420, 430, 440 of the electrically insulating elements 400 of the electrical connector 10 is facilitated.

In order to move the lower cover part 200 from the open position 205 into the closed position 206, the snap-in tongues 233 of the retaining spring 230 can be disengaged with little effort from the detents 235 on the internal side 202 of the lower cover part 200. The lower cover part 200 can then be pivoted without hindrance from the open position 205 into the closed position 206.

Figure 18:
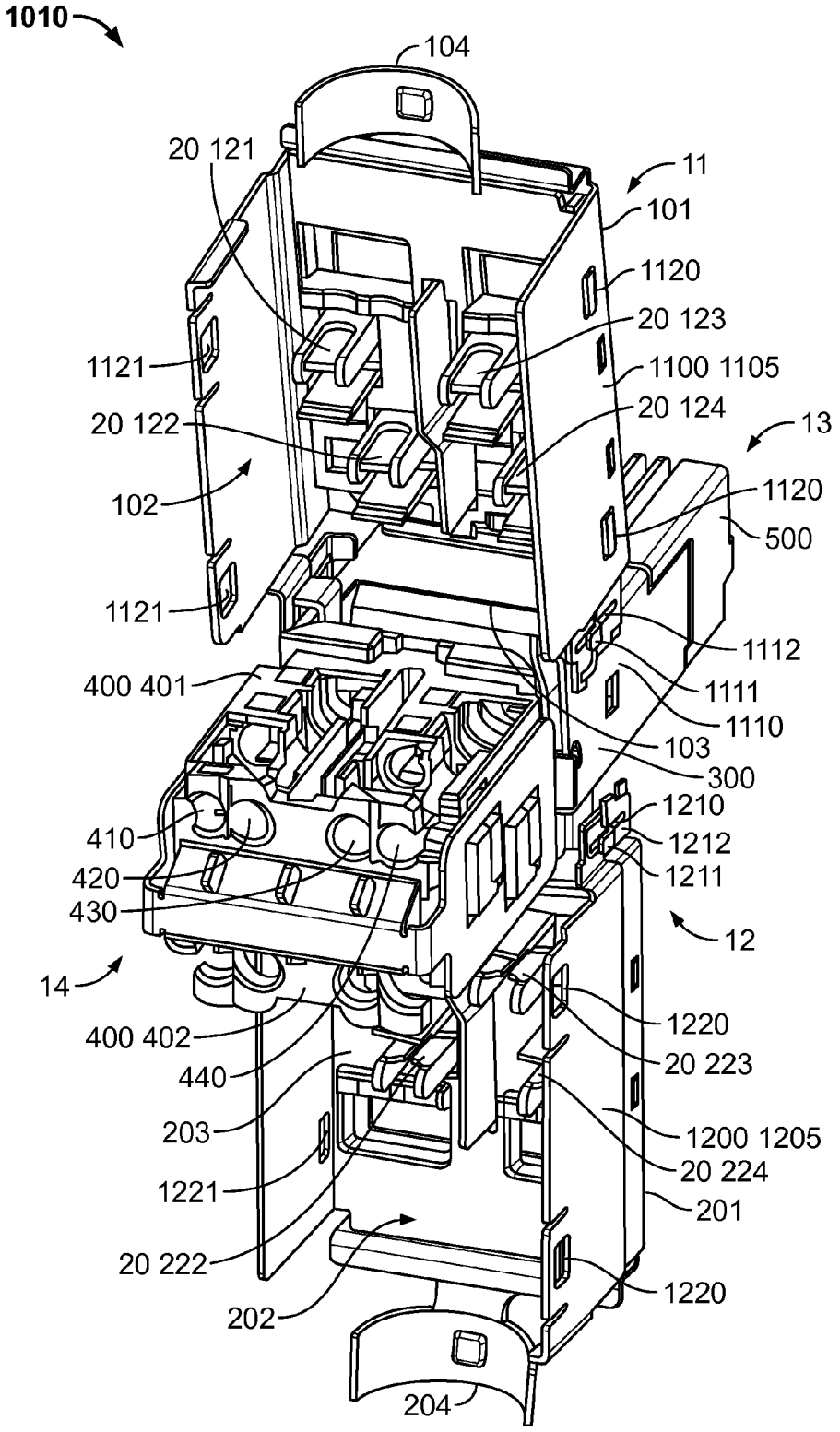
FIG. 18 is a perspective view of another electrical connector according to the invention.
Figure 19:
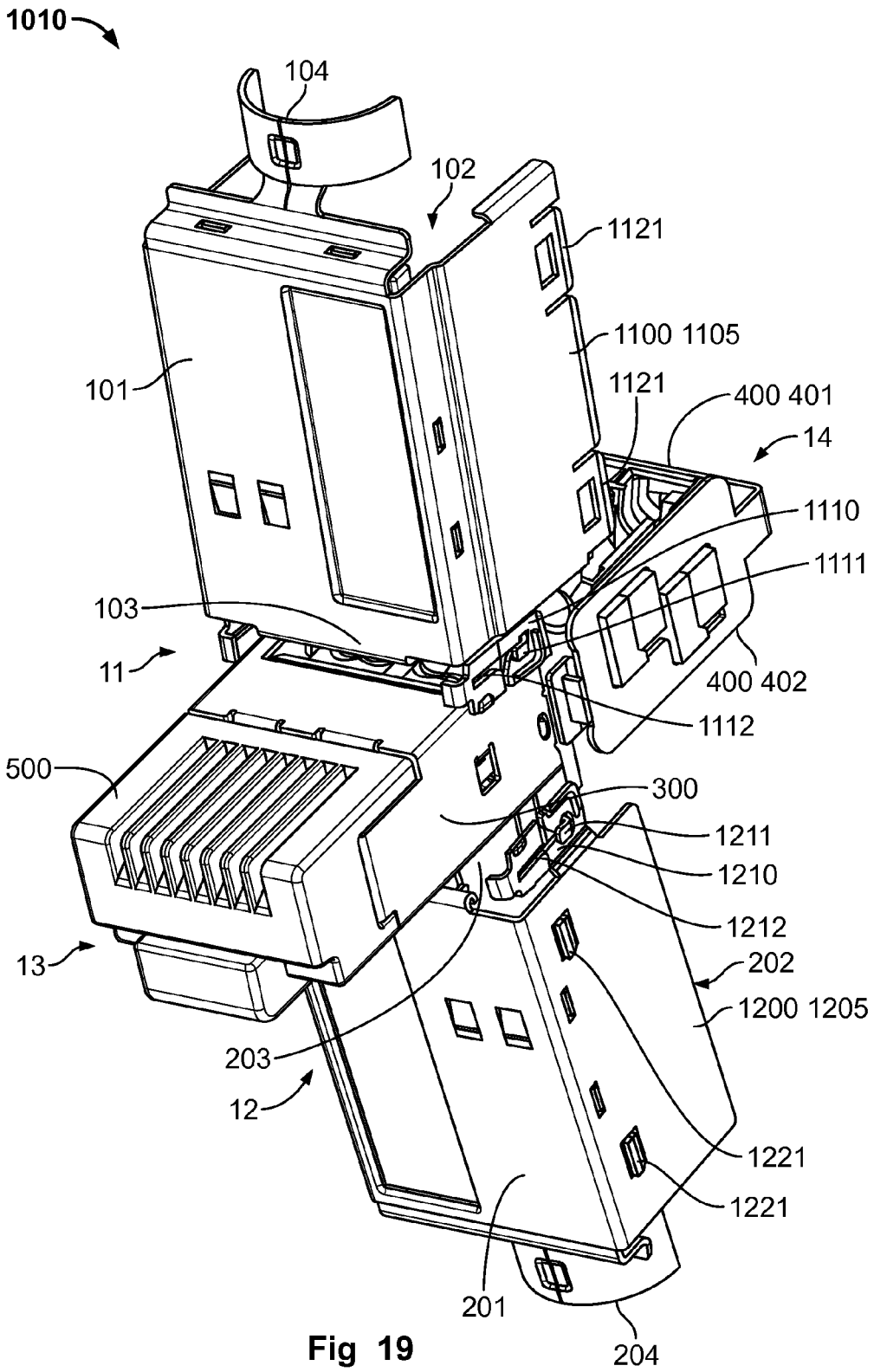
FIG. 19 is a perspective view of the electrical connector of FIG. 18.

FIGS. 18 and 19 show an electrical connector 1010 according to another embodiment of the invention. Components of the electrical connector 1010, which are identical or substantially identical to the corresponding components of the electrical connector 10, are provided in the views of electrical connector 1010 with the same reference symbols as in the views of electrical connector 10, and will not be described again in detail hereafter. In the following, only the differences between electrical connector 1010 and electrical connector 10 will be described.

Electrical connector 1010 differs from electrical connector 10 in that, instead of the upper cover part 100, the electrical connector 1010 has an upper cover part 1100, and instead of the lower cover part 200 a lower cover part 1200. On the internal side 102 of the upper cover part 1100, as for the upper cover part 100 of the electrical connector 10, the first upper termination clamp 121, the second upper termination clamp 122, the third upper termination clamp 123 and the fourth upper termination clamp 124 are arranged. On the internal side 202 of the lower cover part 1200 of the electrical connector 1010, as for the lower cover part 200 of the electrical connector 10, the first lower termination clamp 221, the second lower termination clamp 222, the third lower termination clamp 223, and the fourth lower termination clamp 224 are arranged. The upper termination clamps 121, 122, 123, 124 and the lower termination clamps 221, 222, 223, 224, as for the electrical connector 10, are meant for cutting to length and electrically contacting the cores of a cable.

By means of an upper joint 1110, the upper cover part 1100 is hingedly connected to the middle housing part 300 of the electrical connector 1010. The upper joint 1110 comprises two pivot pins 1111 which are arranged on opposite side surfaces of the middle housing part 300 of the electrical connector 1010. The pivot pins 1111 engage two elongated slots 1112 arranged on the upper cover part 1100. The pivot pins 1111 are thus guided within the elongated slots 1112 of the upper joint 1110. The upper joint 1110 allows for a rotating motion and a translating motion of the upper cover part 1100 relative to the middle housing part 300 of the electrical connector 1010, i.e. pivoting of the upper cover part 1100 against the middle housing part 300 and a linear motion of the upper cover part 1100 relative to the middle housing part 300. FIGS. 18 and 19 show the upper cover part 1100 in an open position 1105 relative to the middle housing part 300 of the electrical connector 1010.

By means of a lower joint 1210, the lower cover part 1200 is connected to the middle housing part 300 of the electrical connector 1010. The lower joint 1210 comprises two pivot pins 1211 arranged on opposite side surfaces of the middle housing part 300 of the electrical connector 1010. Furthermore, the lower joint 1210 includes two elongated slots 1212 arranged in the lower cover part 1200. The pivot pins 1211 of the lower joint 1210 are guided within the elongated slots 1212 of the lower joint 1210. The lower joint 1210 allows for a rotating motion and a translating motion of the lower cover part 1200 relative to the middle housing part 300 of the electrical connector 1010. Thus, the lower joint 1210 allows for the lower cover part 1200 of the electrical connector 1010 to pivot against the middle housing part 300 and move the lower cover part 1200 in a linear motion relative to the middle housing part 300. In the views of FIGS. 18 and 19, the lower cover part 1200 is in an open position 1205.

In the open position 1105 of the upper cover part 1100 of the electrical connector 1010 and the open position 1205 of the lower cover part 1200 of the electrical connector 1010, the cores of a cable can be arranged within the core guides 410, 420, 430, 440 of the first electrically insulating element 401 and the second electrically insulating element 402 of the electrical connector 1010, as explained with reference to electrical connector 10.

Figure 20:
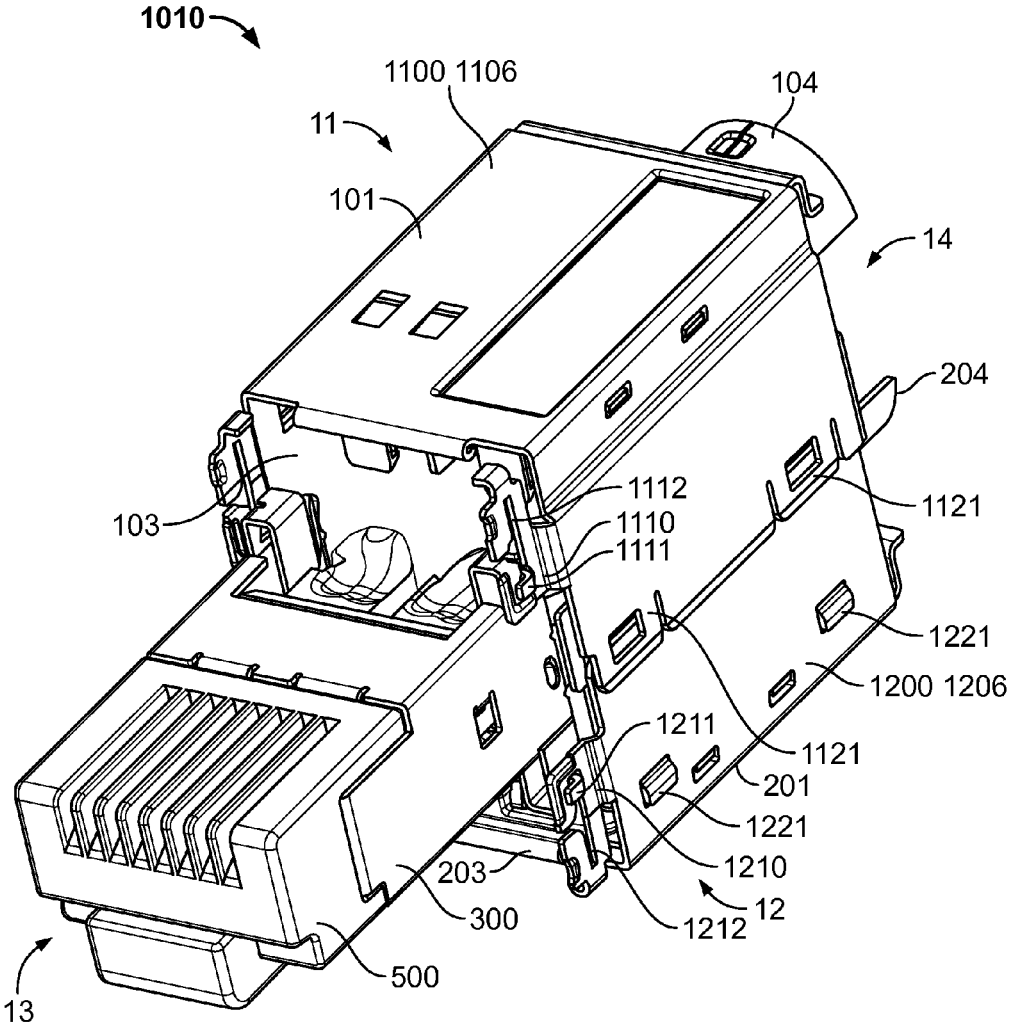
FIG. 20 is a perspective view of the electrical connector of FIG. 18.

Subsequently, the upper cover part 1100 and the lower cover part 1200 of the electrical connector 1010 can be closed by pivoting against the middle housing part 300 of the electrical connector 1010. The upper cover part 1100 and the lower cover part 1200 are then pivoted counter-rotatingly. The upper cover part 1100 is pivoted about a rotational axis formed by the pivot pins 1111 of the upper joint 1110. The lower cover part 1200 is pivoted about a rotational axis formed by the pivot pins 1211 of the lower joint 1210. FIG. 20 shows the electrical connector 1010 when the upper cover part 1100 and lower cover part 1200 have been closed. The upper cover part 1100 is in a closed position 1106. The lower cover part 1200 is in a closed position 1206.

The upper cover part 1100 of the electrical connector 1010 can be moved through the elongated slots 1112 with respect to rotational axis formed by the pivot pins 1111 of the upper joint 1110. The position of the rotational axis of the rotating motion of the upper cover part 1100 is thus variable. Accordingly, the position of the rotational axis formed by the pivot pins 1211 of the lower joint 1210 of the rotating motion of the lower cover part 1200 relative to the lower cover part 1200 is also variable. Thereby, positions of the upper cover part 1100 and the lower cover part 1200 of the electrical connector 1010 can advantageously be adapted to a diameter of a cable to be connected to the electrical connector 1010.

The closed position 1106 of the upper cover part 1100 and the closed position 1206 of the lower cover part 1200 is represented in FIG. 20; the upper cover part 1100 and the lower cover part 1200 are oriented in parallel to the middle housing part 300 of the electrical connector 1010. However, the upper termination clamps 121, 122, 123, 124 of the upper cover part 1100 and the lower termination clamps 221, 222, 223, 224 of the lower cover part 1200 have not yet severed and electrically contacted the cores arranged within the core guides 410, 420, 430, 440 of the electrically insulating elements 401, 402 of the electrical connector 1010.

Severing and contacting the cores of the cable are done in a subsequent further mounting step by a linear motion of the upper cover part 1100 in the direction of the middle housing part 300 and simultaneous linear motion of the lower cover part 1200 in the direction of the middle housing part 300. The linear motions of the upper cover part 1100 and the lower cover part 1200 are oriented contra-directionally. Thus, the upper cover part 1100 and the lower cover part 1200 of the electrical connector 1010 are also moved towards each other by the linear motions of the upper cover part 1100 and the lower cover part 1200.

During linear motion of the upper cover part 1100 in the direction of the middle housing part 300, the pivot pins 1111 of the upper joint 1110 are moved linearly within the elongated slots 1112 of the upper joint 1110. Accordingly, during linear motion of the lower cover part 1200 in the direction of the middle housing part 300, the pivot pins 1211 of the lower joint 1210 are displaced linearly within the elongated slots 1212 of the lower joint 1210.

During linear motion of the upper cover part 1100 in the direction of the middle housing part 300, the four upper termination clamps 121, 122, 123, 124 on the internal side 102 of the upper cover part 1100 sever the four cores of the cable arranged within the core guides 410, 420, 430, 440 of the first electrically insulating element 401 of the electrical connector 1010 substantially all at the same time, and electrically contact the cores substantially all at the same time. Accordingly, the lower termination clamps 221, 222, 223, 224 of the lower cover part 1200 arranged on the internal side 202 of the lower cover part 1200 sever the cores of the cable arranged within the core guides 410, 420, 430, 440 of the second electrically insulating element 402 of the electrical connector 1010 during linear motion of the lower cover part 1200 in the direction of the middle housing part 300 substantially all at the same time and contact said cores substantially all at the same time.

Figure 21:
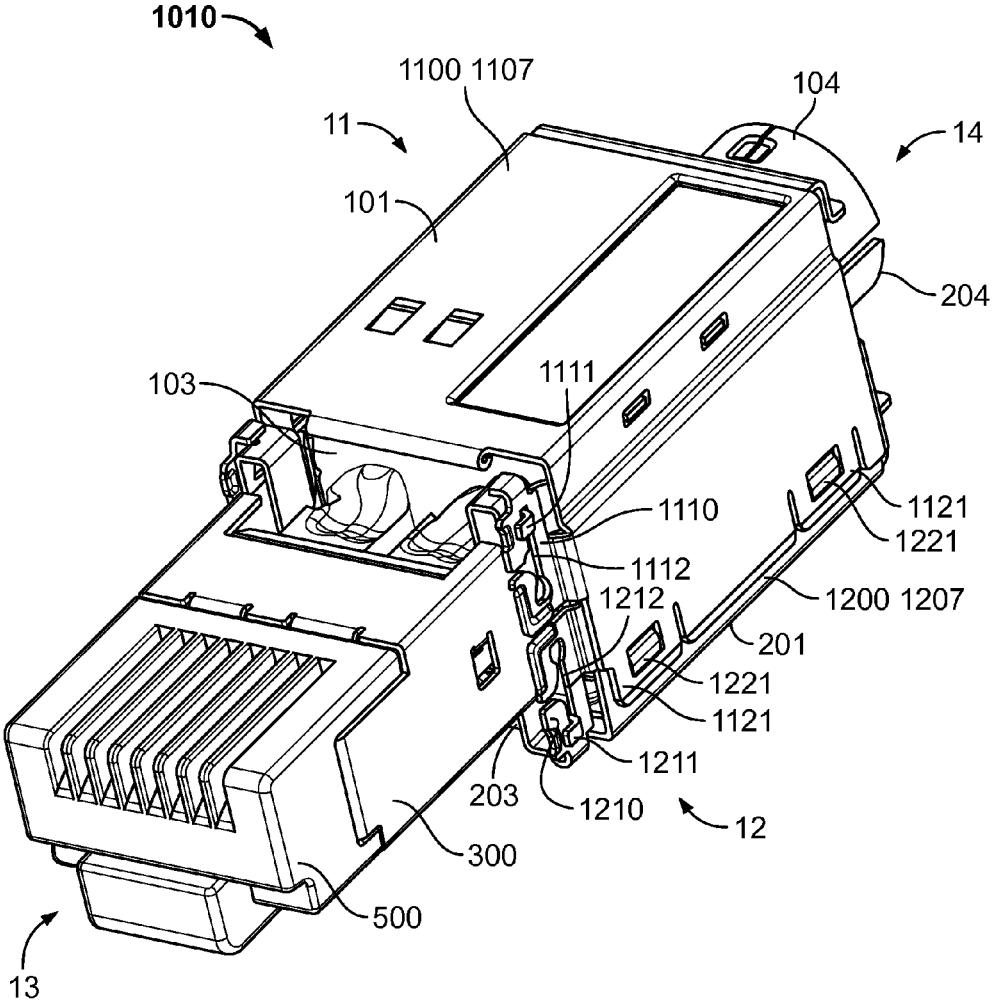
FIG. 21 is a perspective view of the electrical connector of FIG. 18.

By linear motion of the upper cover part 1100 of the electrical connector 1010 in the direction of the middle housing part 300, the upper cover part 1100 is transitioned from the closed position 1106 into an interlocked position 1107. Accordingly, during linear motion of the lower cover part 1200 in the direction of the middle housing part 300, the lower cover part 1200 is transitioned from the closed position 1206 into an interlocked position 1207. FIG. 21 shows an view of the electrical connector 1010 where the upper cover part 1100 is in interlocked position 1107 and the lower cover part 1200 is in interlocked position 1207.

In FIG. 18 it can be seen that on a first side wall, the upper cover part 1100 has two snap-in hooks 1120 and on a second side wall opposite the first side wall two snap-in tongues 1121. On a first side wall of the lower cover part 1200, the lower cover part 1200 has two snap-in tongues 1220 and, on a second side wall of the lower cover part 1200 opposite the first side wall of the lower cover part 1200, two snap-in hooks 1221.

During linear motions of the upper cover part 1100 and the lower cover part 1200, by which the cover parts 1100, 1200 are transitioned from the closed positions 1106, 1206 into the interlocked positions 1107, 1207, the side walls of the upper cover part 1100 and the lower cover part 1200 are moved past each other in parallel. In this case, the second side wall of the lower cover part 1200 is guided between the middle housing part 300 and the second side wall of the upper cover part 1100. The first side wall of the upper cover part 1100 is guided between the first side wall of the lower cover part 1200 and the middle housing part 300.

In the interlocked positions 1107, 1207 of the upper cover part 1100 and the lower cover part 1200 represented in FIG. 21, the snap-in hooks 1120 on the first side wall of the upper cover part 1100 snap into the snap-in tongues 1220 on the first side wall of the lower cover part 1200. The snap-in hooks 1221 of the second side wall of the lower cover part 1200 snap into the snap-in tongues 1121 of the second side wall of the upper cover part 1100.

By interlocking the snap-in hooks 1120, 1221 with the snap-in tongues 1121, 1220, the upper cover part 1100 and the lower cover part 1200 are fixed in the interlocked positions 1107, 1207. Thereby, unintentional movement of the cover part 1100, 1200 out of the interlocked positions 1107, 1207 back into the closed positions 1106, 1206 is prevented. Furthermore, interlocking of the snap-in hooks 1120, 1221 with the snap-in tongues 1121, 1220 indicates that the upper cover part 1100 and the lower cover part 1200 have reached the interlocked positions 1107, 1207 thereof, and that the cores of the cable connected to the electrical connector 1010 have been reliably electrically contacted.

However, providing snap-in hooks 1120, 1221 and snap-in tongues 1121, 1220 can be omitted. In the interlocked positions 1107, 1207 of the upper cover part 1100 and lower cover part 1200, the cores of the cable contacted via the electrical connector 1010 is clamped in the upper termination clamps 121, 122, 123, 124 of the upper cover part 1100 and the lower termination clamps 221, 222, 223, 224 of the lower cover part 1200. Thereby, the upper cover part 1100 and the lower cover part 1200 are reliably retained in the interlocked positions 1107, 1207 even without interlocking of the snap-in hooks 1120, 1221 and snap-in tongues 1121, 1220.

If the snap-in hooks 1120, 1221 and snap-in tongues 1121, 1220 are omitted, the upper cover part 1100 and lower cover part 1200 can be shaped so that during linear motions of the upper cover part 1100 and lower cover part 1200 by which the cover parts 1100, 1200 are transitioned from the closed positions 1106, 1206 into the interlocked positions 1107, 1207, the side walls of the upper cover part 1100 and lower cover part 1200 are not guided past each other. Instead, the side walls of the upper cover part 1100 and lower cover part 1200 are then located in abutment in the interlocked positions 1107, 1207 or are still somewhat spaced apart.

Figure 22:
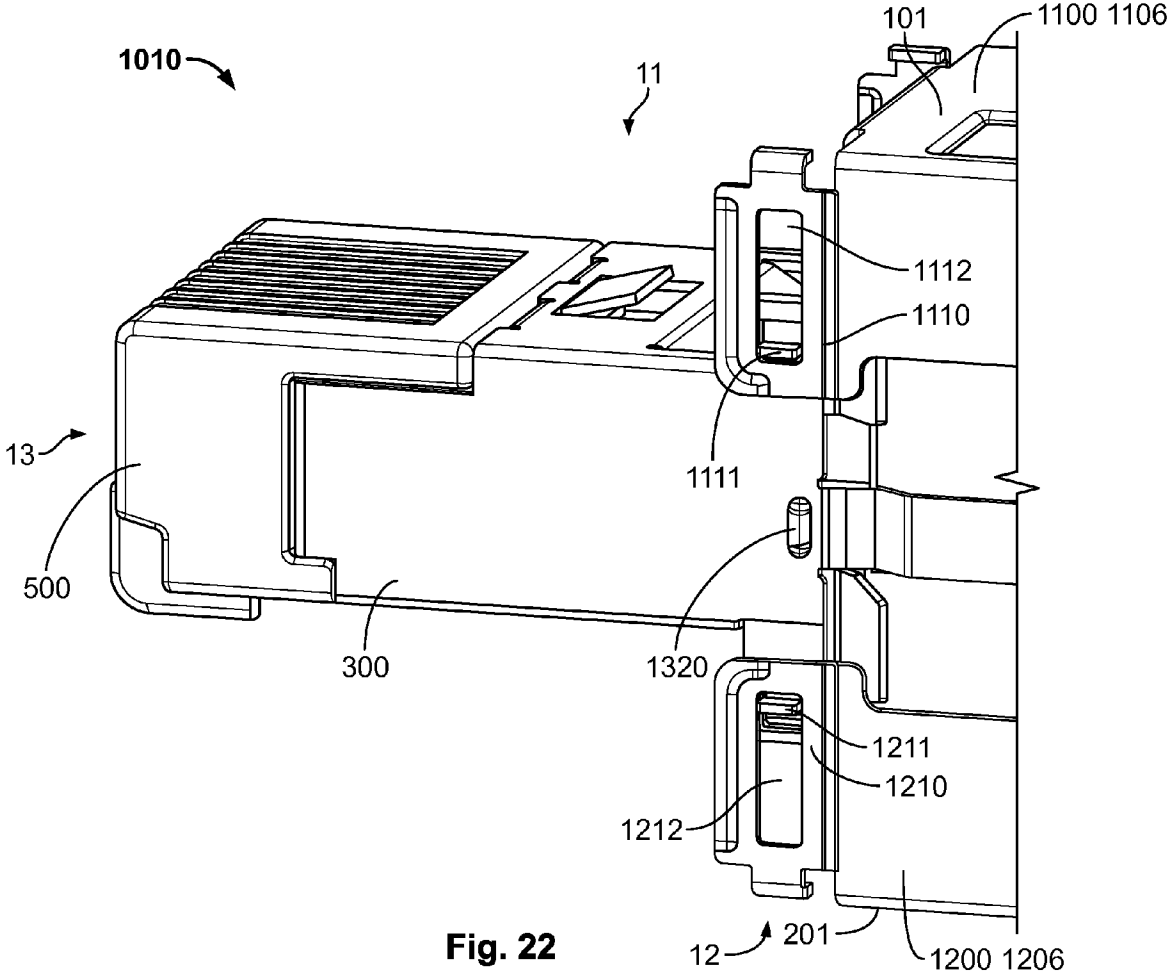
FIG. 22 is an enlarged perspective view of a portion of FIG. 20.
Figure 23:
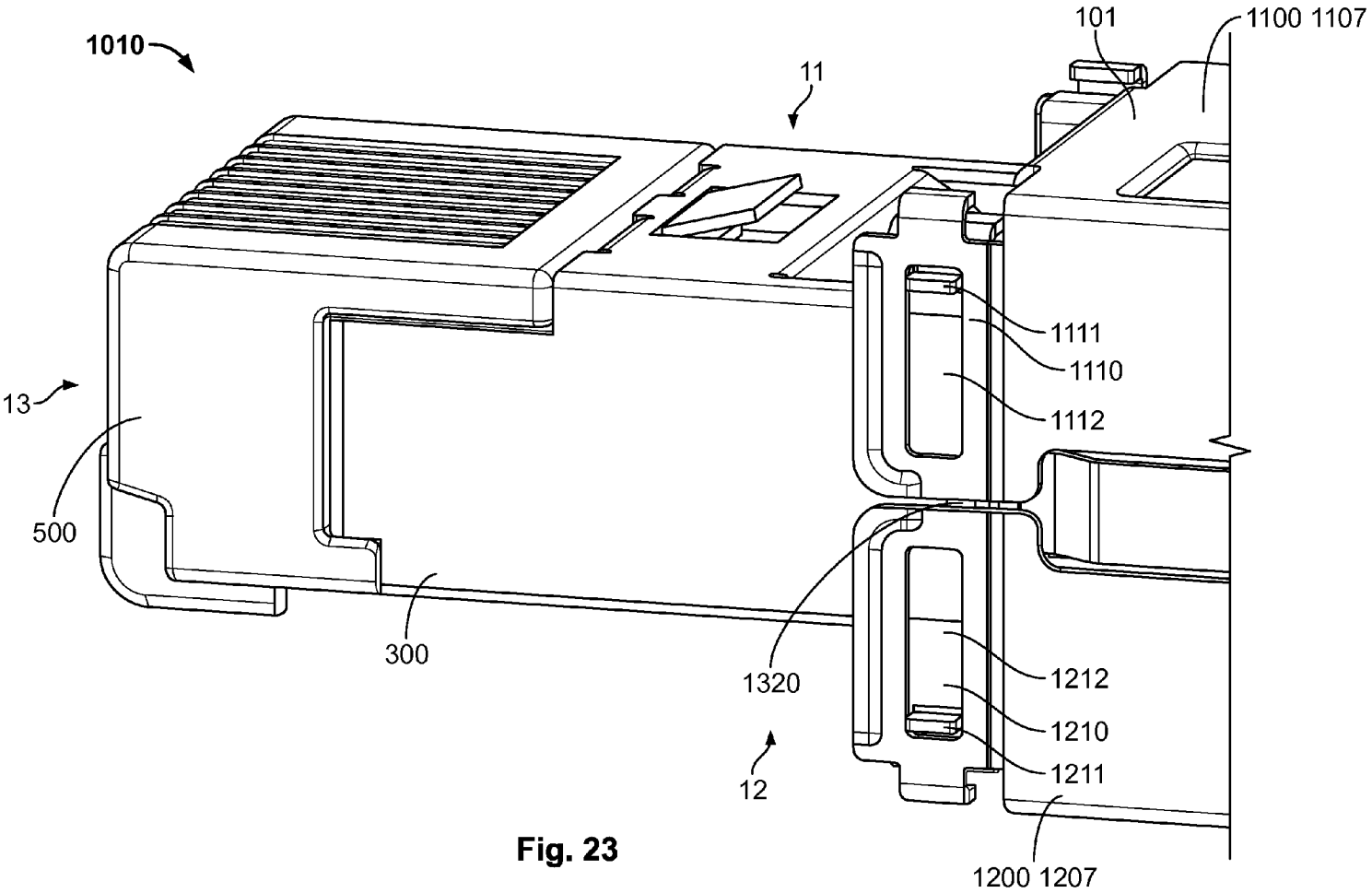
FIG. 23 is an enlarged perspective view of a portion of FIG. 21.

FIG. 22 shows an enlarged perspective view of one part of the electrical connector 1010. In the view of FIG. 22, the upper cover part 1100 and the lower cover part 1200 of the electrical connector 1010 are in the closed positions 1106, 1206. FIG. 23 shows another perspective view of one part of the electrical connector 1010. In the view of FIG. 23, the upper cover part 1100 and the lower cover part 1200 of the electrical connector 1010 are in the interlocked positions 1107, 1207 thereof.

In the views of FIGS. 22 and 23, the elongated slots 1112 of the upper joint 1110 arranged in the upper cover part 1100 and the elongated slots 1212 of the lower joint 1210 arranged in the lower cover part 1200 are made slightly different from those in the views of FIGS. 18 to 21. However, functioning of the upper joint 1110 and the lower joint 1210 is the same in both alternatives. The upper joint 1110 allows for a pivoting motion of the upper cover part 1100, where the upper cover part 1100 is rotated relative to the middle housing part 300 of the electrical connector 1010 about the pivot pin 1111 of the upper joint 1110, whereby the upper cover part 1100 can be pivoted between the open position 1105 and the closed position 1106. The elongated slots 1112 of the upper joint 1110 then allow for displacement of the rotational axis relative to the upper cover part 1100. Furthermore, the upper joint 1110 allows for linear motion of the upper cover part 1100 relative to the middle housing part 300 of the electrical connector 1010, where the pivot pins 1111 of the upper joint 1110 are displaced linearly in the elongated slots 1112 of the upper cover part 1100, and by which the upper cover part 1100 can be transitioned from the closed position 1106 into the interlocked position 1107. Accordingly, the lower joint 1210 allows for a rotating motion of the lower cover part 1200 relative to the middle housing part 300 of the electrical connector 1010 about a rotational axis which can be displaced relative to the lower cover part 1200. Due to this rotating motion, the lower cover part 1200 can be pivoted between the open position 1205 and the closed position 1206. Furthermore, the lower joint 1210 allows for a linear motion of the lower cover part 1200 relative to the middle housing part 300 of the electrical connector 1010, by which the lower cover part 1200 can be transitioned from the closed position 1206 into the interlocked position 1207 thereof.

FIG. 22 shows that on two opposite side surfaces, the middle housing part 300 of the electrical connector 1010 has one knob 1320, respectively. The knobs 1320 are approximately centered between the top side 11 and the bottom side 12 of the electrical connector 1010. The knobs 1320 can be made as stampings, for example.

During linear motion of the upper cover part 1100 and the lower cover part 1200 of the electrical connector 1010 by which the upper cover part 1100 and the lower cover part 1200 are moved from the closed positions 1106, 1206 into the interlocked position 1107, 1207 thereof, the side walls of the upper cover part 1100 and the lower cover part 1200 are guided via the knobs 1320 of the middle housing part 300 and clamped thereby. Clamping of the side walls of the upper cover part 1100 and the lower cover part 1200 at the knobs 1320 of the middle housing part 300 of the electrical connector 1010 in the interlocked positions 1107, 1207 of the upper cover part 1100 and the lower cover part 1200 prevents unintentional movement of the cover parts 1100, 1200 from the interlocked positions 1107, 1207 back into the closed positions 1106, 1206. Furthermore, in the interlocked positions 1107, 1207, the knobs 1320 of the middle housing part 300 electrically connect the cover parts 1100, 1200 of the upper cover part 1100 and the lower cover part 1200 with each other. Thereby, in the interlocked positions 1107, 1207 thereof, the upper cover part 1100 and the lower cover part 1200 form a closed shield of the electrical connector 1010.

What is claimed is:

1. An electrical connector, comprising:

a middle housing having a circuit board disposed in the middle housing, a first upper contact spring connected to the circuit board in an electrically conductive manner, and a first upper opening;

an upper cover connected to the middle housing and having a first upper termination clamp having a blade portion, wherein the upper cover rotatably and linearly moves with respect to the middle housing between an open position and a closed position;

a lower cover connected to the middle housing and having a first lower termination clamp, wherein the lower cover rotatably and linearly moves with respect to the middle housing between an open position and a closed position; and a cable having a first core, the first core extending into the blade portion of the first upper termination clamp;

wherein in the closed position of the upper cover, the first upper termination clamp electrically contacts the first core and abuts the first upper contact spring.

2. The electrical connector according to claim 1, wherein the linear motion of the upper cover with respect to the middle housing ends in the closed position.

3. The electrical connector according to claim 2, wherein the first upper termination clamp has a blade portion.

4. The electrical connector according to claim 3, wherein the blade portion extends through a portion of the first core in the closed position.

5. The electrical connector according to claim 4, wherein, prior to the linear motion, the blade portion does not extend through a portion of the first core.

6. The electrical connector according to claim 1, wherein the middle housing has an electrically insulating element.

7. The electrical connector according to claim 6, wherein the first upper opening and first upper contact spring are disposed on the electrically insulating element.

8. The electrical connector according to claim 1, further comprising a second upper termination clamp disposed on the upper cover, a second upper contact spring disposed on the middle housing, a second upper opening disposed on the middle housing, and a second core of the cable.

9. The electrical connector according to claim 8, wherein the second core extends into the second upper opening, and in the closed position of the upper cover, the second upper termination clamp contacts the second core in an electrically conductive manner and abuts the second upper contact spring.

10. The electrical connector according to claim 1, wherein the linear motion of the lower cover with respect to the middle housing ends in the closed position.

11. The electrical connector according to claim 10, wherein the middle housing has a first lower contact spring and a first lower opening.

12. The electrical connector according to claim 11, further comprising a third core of the cable extending into the first lower opening, and in the closed position of the lower cover, the first lower termination clamp contacts the third core in an electrically conductive manner and abuts the first lower contact spring.

13. The electrical connector according to claim 12, wherein the lower cover has at least one elongated slot, and the middle housing has at least one pivot pin extending into the elongated slot, the elongated slot formed to permit the pivot pin to rotatably and linearly move within the elongated slot.

14. The electrical connector according to claim 1, wherein the upper cover and lower cover are interlocked.

15. The electrical connector according to claim 13, wherein the middle housing has a knob, and the upper cover and lower cover are interlocked at the knob.

16. The electrical connector according to claim 1, wherein the circuit board has a track electrically connecting the first upper contact spring to a contact element.

* * * * *